US012630947B2

(12) United States Patent
Smith et al.

(10) Patent No.: US 12,630,947 B2
(45) Date of Patent: May 19, 2026

(54) PITCH COMPOSITIONS FOR SPINNING INTO CARBON ARTICLES AND METHODS RELATING THERETO

(71) Applicant: EXXONMOBIL TECHNOLOGY AND ENGINEERING COMPANY, Annandale, NJ (US)

(72) Inventors: Stuart E. Smith, Easton, PA (US); William M. Ferry, Rochester Hills, MI (US); Kazem V. Edmond, Lebanon, NJ (US); Manesh Gopinadhan, Basking Ridge, NJ (US); Nicolas J. Alvarez, Drexel Hill, PA (US); Heedong Yoon, Philadelphia, PA (US); Clarence E. Chase, Bensalem, PA (US); Daniel J. Ryan, Easton, PA (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 437 days.

(21) Appl. No.: 18/249,492

(22) PCT Filed: Nov. 10, 2021

(86) PCT No.: PCT/US2021/072316

§ 371 (c)(1),
(2) Date: Apr. 18, 2023

(87) PCT Pub. No.: WO2022/109523

PCT Pub. Date: May 27, 2022

(65) Prior Publication Data

US 2023/0416949 A1 Dec. 28, 2023

Related U.S. Application Data

(60) Provisional application No. 63/116,598, filed on Nov. 20, 2020.

(51) Int. Cl.
*D01F 9/145* (2006.01)
*D01F 9/32* (2006.01)

(52) U.S. Cl.
CPC ..... *D01F 9/145* (2013.01); *D01F 9/322* (2013.01); *D10B 2101/12* (2013.01)

(58) Field of Classification Search
CPC . D01F 9/145; D01F 9/322; D01F 9/15; D01F 9/155; D10B 2101/12; Y02B 10/30
See application file for complete search history.

(56) References Cited

U.S. PATENT DOCUMENTS

| | | | | |
|---|---|---|---|---|
| 4,927,620 | A | 5/1990 | Ward et al. | |
| 6,171,696 | B1 | 1/2001 | Takemura et al. | |
| 2018/0175391 | A1* | 6/2018 | Komura | D01D 5/36 |

FOREIGN PATENT DOCUMENTS

| | | | |
|---|---|---|---|
| CN | 104195676 | A | 12/2014 |
| JP | 2006214033 | A | 8/2006 |

OTHER PUBLICATIONS

International Search Report and Written Opinion for PCT/US2021/072316 dated Mar. 28, 2022.
Chinese Office Action for CN Patent Application No. 202180071108.8 dated Jun. 25, 2025. English Machine Translation with Original Untranslated Version, PDF file. 21 pages.

* cited by examiner

*Primary Examiner* — Daniel C. Mccracken
(74) *Attorney, Agent, or Firm* — C. Tumey Law Group PLLC

(57) ABSTRACT

Pitch compositions suitable for spinning may comprise: a pitch having a softening point (SP) below 400° C. and is capable of achieving a radial Hencky strain prior to break of about 0.7 to about 10, at spinning temperature ($T_s$) ranging from about SP−30° C. to about SP+80° C. Methods for producing a carbon fiber from a pitch composition at a temperature within a spinning temperature ($T_s$) range may comprise determining a temperature range wherein the maximum radial Hencky strain ($\varepsilon_R$) lies above a minimum process radial Hencky strain, and wherein the minimum process radial Hencky strain is within a range of about 0.7 to about 10. The spinning temperature ($T_s$) range may be determined by measuring a maximum radial Hencky strain ($\varepsilon_R$) prior to break at a series of different temperatures and strain rates. Carbon fiber composites may comprise of the said carbon fiber.

11 Claims, 6 Drawing Sheets

PITCH COMPOSITIONS FOR SPINNING INTO CARBON ARTICLES AND METHODS RELATING THERETO

FIELD OF THE INVENTION

The present disclosure relates to pitch compositions and methods for their production and use.

BACKGROUND OF THE INVENTION

In recent years, the carbon fiber industry has been growing steadily to meet the demand from a wide range of industries such as automotive (e.g., body parts such as deck lids, hoods, front end, bumpers, doors, chassis, suspension systems such as leaf springs, drive shafts), aerospace (such as aircraft and space systems), high performance aquatic vessels (such as yachts and rowing shells), airplanes, sports equipment (e.g., golf club, tennis racket, ski boards, snowboards, helmets, rowing or water skiing equipment), construction (non-structural and structural systems), military (e.g., flying drones, armor, armored vehicles, military aircraft), wind energy industries, energy storage applications, fireproof materials, carbon-carbon composites, carbon fibers, and in many insulating and sealing materials used in construction and road building (e.g., concrete), turbine blades, light weight cylinders and pressure vessels, off-shore tethers and drilling risers, medical, for example. The non-limiting properties of the carbon fibers make such material suitable for high-performance applications: high bulk modulus and tensile modulus (depending on the morphology of the carbon fiber), high electrical and thermal conductivities, high specific density, etc. However, the high cost of carbon fiber limits its applications and widespread use, in spite of the remarkable properties exhibited by such material. Hence, developing low-cost technologies to produce carbon fibers has been a major challenge for researchers and key manufacturers.

Carbon fiber can be produced from pitch. A pitch is a carbon-containing feedstock which can be classified as an isotropic pitch, or a mesophase pitch. Both isotropic and mesophase pitch can be complex mixtures of aromatic molecules; however, the aromatic molecules in an isotropic pitch are randomly oriented, whereas in a mesophase pitch, at least a portion of these aromatic molecules are ordered. A mesophase pitch may have a heterogeneous two-phase structure comprising the said ordered aromatic molecules (e.g., anisotropic region), and an isotropic region.

A pitch can be produced from petroleum, coal tar, biomass tar, or from an acid-catalyzed oligomerization of small molecules (e.g., naphthalene), for example. In general, an isotropic pitch formation precedes a mesophase pitch formation. As an example, one of the fractionation products from a catalytic cracking process or slurry hydrocracking process can be a bottoms or "pitch" fraction. Such a pitch fraction can correspond to an isotropic pitch. Alternatively, this fractionation product can be used as a feed to a reaction zone, wherein the feed is further heat-treated to form an isotropic pitch. If the said isotropic pitch is further treated (e.g., heat-treated), a mesophase pitch can be formed.

Carbon fiber properties are heavily influenced by the type of pitch used. Isotropic pitch produces general-purpose carbon fibers that typically have lower tensile modulus and tensile strengths than fibers produced from mesophase pitch. Isotropic pitch-based carbon fibers can be used in concrete reinforcement, activated carbon fiber products and battery casing to name a few product applications. Mesophase pitch-based carbon fibers can be used in higher-performance applications due to their higher tensile modulus, strength and thermal and electrical conductivities. Select product applications for mesophase pitch-based carbon fiber include: industrial rollers and robotic arms, sporting goods, construction reinforcement and satellite components.

The production of carbon fiber from a pitch can be achieved as follows: melt spinning; stabilization; carbonization; and graphitization. During a melt spinning process, the pitch is heated to sufficiently high temperatures to melt the pitch and reduce its viscosity so that the heated pitch can pass through a spinneret. The resulting fiber produced from a pitch may then be wound on a spinning spool, or laid into a fibrous mat.

The viscosity of many types of pitch materials is strongly dependent on temperature. Small temperature fluctuations can cause large variations in the fiber diameter and/or tensile stress within the filament during fiber formation. In order to overcome this difficulty, conventional production of carbon fiber from pitch requires the process to operate within a narrow temperature window, which can be challenging to maintain under commercial production conditions. Additionally, difficulties in maintaining the production process in the desired temperature window can also limit the throughput of the produced fiber. In some instances, the sensitivity of the fiber formation process to small temperature variations at a steady state can result in fiber breakage due to the inability of the pitch to flow through the spinneret and/or due to structural weak points created by size variations and/or tensile stress. Consequently, predicting/evaluating the spinnability of a pitch and identifying the spinning conditions of a pitch from its material properties are critical.

A variety of spinning conditions (e.g., temperature, die design, draw down ratio (DDR), etc.) have been used, and based on its performance under such conditions, a pitch would be characterized as having either a good or a poor spinnability. Traditional pitch specifications, such as softening point and mesophase content (vol %), serve as predictors of spinnability. However, such specifications are not fully sufficient to assure spinnability. To evaluate spinnability, large quantities of pitch are required to evaluate a variety of different spinning conditions. Accordingly, a method capable of evaluating and establishing material (e.g., a pitch) properties directly relevant to the spinning process, as well as enabling the production of the material with tailored properties for good spinnability, is highly desired.

SUMMARY OF THE INVENTION

The present disclosure provides pitch compositions suitable for spinning. The pitch compositions comprise: a pitch having a softening point (SP) below 400° C. and capable of achieving a radial Hencky strain prior to break of about 0.7 to about 10, at spinning temperature ($T_s$) ranging from about SP−30° C. to about SP+80° C.

The present disclosure provides processes for making pitch compositions suitable for spinning. The processes comprise: producing a carbon fiber from a pitch composition at a temperature within a spinning temperature ($T_s$) range, wherein the spinning temperature ($T_s$) range is determined by measuring a maximum radial Hencky strain (εR) prior to break at a series of different temperatures (° C.) and strain rates ($s^{-1}$); and determining a temperature range wherein the maximum radial Hencky strain (εR) lies above a minimum process radial Hencky strain, and wherein the minimum process radial Hencky strain is within a range of about 0.7 to about 10.

The present disclosure provides carbon fiber composites. The carbon fiber composites comprise of a carbon fiber produced from a pitch composition, wherein the pitch composition comprises: a pitch having a softening point (SP) below 400° C. and capable of achieving a radial Hencky strain prior to break of about 0.7 to about 10, at spinning temperature ($T_s$) ranging from about SP−30° C. to about SP+80° C.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, as will occur to one having ordinary skill in the art and having the benefit of this disclosure.

DETAILED DESCRIPTION OF THE INVENTION

Figure 1A:
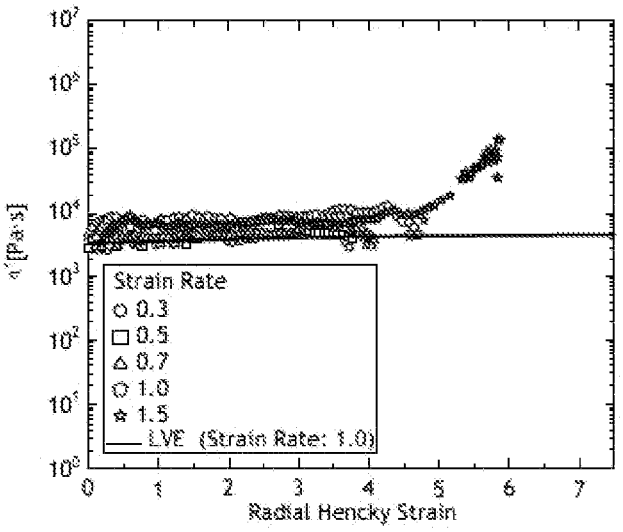
FIG. 1A is a graph depicting the extensional viscosity $\zeta^{+}$(Pa·s) versus the radial Hencky strain of an isotropic pitch, at different strain rates ($s^{-1}$), at 150° C.

The present disclosure relates to pitch compositions and methods for their production and use.

As discussed above, there is growing demand for carbon fibers in a variety of industries, especially high-quality carbon fibers, such as those suitable for making wind turbine blades or automotive products, for example. At present, there are a few qualitative analytical options available for evaluating the spinnability of a pitch, but no quantitative analytical properties that are able to accurately define whether a pitch is spinnable. Moreover, there are limited options available for producing spinnable pitch compositions, particularly with the ability to tune the physical properties of the pitch to meet particular application-specific needs. The present disclosure demonstrates that certain quantitative measures of material (e.g., pitch) properties can be used as a way of evaluating and establishing a pitch capability for spinning. This approach provides new techniques and tools to predict the spinnability of a pitch, enables tailored design of pitches with desirable spinning properties (e.g. blending), identifies suitable process conditions for spinning a pitch, as well as enables tailoring of process conditions to produce more robust and stable spinnable pitch for manufacturing carbon fibers, and product applications of these pitches.

The pitch compositions of the present disclosure suitable for spinning may comprise a pitch having a softening point (SP) below 400° C. and capable of achieving a radial Hencky strain prior to break of about 0.7 to about 10, at spinning temperature ($T_s$) ranging from about SP−30° C. to about SP+80° C. Advantageously, such compositions provide improved spinning capability into carbon fibers. Because of these improved properties, the pitch compositions described herein may be useful in producing higher quality carbon fiber composites for automotive body parts, drilling risers, or wind turbine blades, for example. Preferably, the pitch has: a mesophase content of about 5 vol % or less, based on the total volume of the pitch; an axial Hencky strain ranging from about 0.1 and to about 8; an extensional strain rate ranging from about 0.1 $s^{-1}$ to about 100 $s^{-1}$; a maximum critical stress ranging from about 1,000 Pa to about 10,000,000 Pa; and/or an extensional viscosity ranging from about 5 Pa·s to about 500,000 Pa·s. Alternately, the pitch has: a mesophase content ranging from about 5 vol % to about 100 vol %, based on the total volume of the pitch; an axial Hencky strain ranging from about 0.1 to about 8; an extensional strain rate ranging from about 0.1 $s^{-1}$ to about 100 $s^{-1}$; a maximum critical stress ranging from about 1,000 Pa to about 10,000,000 Pa; and/or an extensional viscosity ranging from about 5 Pa·s to about 500,000 Pa·s.

The present disclosure also relates to methods for making carbon fiber composites comprising: combining one or more carbon fibers derived from the pitch with one or more matrices. The matrix used herein can be produced from a thermoset polymer (e.g., cyclopentadiene, dicyclopentadiene, epoxy, pitch, phenolic resins, vinylester, polyimide and polyesters), a thermoplastic polymer (e.g., a thermoplastic polymer including one or more of polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide), cement, concrete, ceramic, metal, metal alloy, or a combination thereof. For example, a pitch itself can be used as a matrix and/or binder for producing a carbon fiber, thus enabling production of carbon-carbon composites.

Furthermore, the present disclosure also relates to methods for blending a spinnable pitch composition comprising: blending a first pitch with one or more pitches, wherein blending enables tailoring either the spinnability of the pitch composition, or the fiber properties, or both.

The present disclosure also relates to methods for making carbon fiber composites comprising: combining at least one composite filler comprising a carbon fiber produced from the forgoing spinnable pitch composition with at least one matrix, wherein the matrix is a thermoset matrix, a thermoplastic matrix, cement, concrete, ceramic, metal, metal alloy, or a combination thereof.

All numerical values within the detailed description and the claims herein are modified by "about" or "approximately" with respect to the indicated value, and take into account experimental error and variations that would be expected by a person having ordinary skill in the art. Unless otherwise indicated, ambient temperature (room temperature) is from about 18° C. to about 20° C.

The following abbreviations are used herein: DSC is differential scanning calorimetry; $T_g$ is glass transition temperature; MCRT is microcarbon residue test; Pa·s is Pascal-second; wt % is weight percent; vol % is volume percent; psi is pounds per square inch; psig is pounds per square inch gauge; WHSV is weight hourly space velocity.

As used in the present disclosure and claims, the singular forms "a," "an," and "the" include plural forms unless the context clearly dictates otherwise.

The term "and/or" as used in a phrase such as "A and/or B" herein is intended to include "A and B," "A or B," "A," and "B."

Where the term "between" is used herein to refer to ranges, the term encompasses the endpoints of the range. That is, "between 2% and 10%" refers to 2%, 10% and all percentages between those terms.

As used herein, the term "pitch" refers to a high-boiling complex mixture of mainly aromatic and alkyl-substituted aromatic compounds that are glassy materials at ambient temperature and have a softening point above 50° C. These aromatic compounds are primarily hydrocarbons, but heteroatoms and traces of metals can be present within these materials. When cooled from a melt, a pitch solidifies into a glassy state and the large polydispersity (size and shape) inhibits crystallization even at small cooling rates. Pitches may include petroleum pitches, coal tar pitches, natural asphalts, pitches contained as by-products in the naphtha cracking industry, pitches of high carbon content obtained from petroleum asphalt and other substances having properties of pitches produced as products in various industrial production processes. Pitches exhibit a broad softening temperature range and are typically derived from petroleum, coal tar, plants, or catalytic oligomerization of small molecules (e.g., acid-catalyzed oligomerization). A pitch can also be referred to as tar, bitumen, or asphalt. When a pitch is produced from plants, it is also referred to as resin. Various pitches may be obtained as products in the gas oil or naphtha cracking industry as a carbonaceous residue consisting of a complex mixture of primarily aromatic organic compounds, which are solid at room temperature, and exhibit a relatively broad softening temperature range. Hence, a pitch can be obtained from heat treatment and distillation of petroleum fractions. A "petroleum pitch" refers to the residuum carbonaceous material obtained from distillation of crude oils and from the catalytic cracking of petroleum distillates. A "coal tar pitch" refers to the material obtained by distillation of coal.

As used herein, the term "mesophase" refers to a polydisperse liquid crystal material consisting of planar aromatic molecules (e.g., discotic liquid crystal). A "mesophase pitch" consists of "mesophase" and optionally an isotropic phase. The mesophase exhibits optical anisotropy when examined using a polarized light microscope. For example, a mesophase pitch can be a pitch containing more than about 10 vol % mesophase, based on the total volume of the pitch. A mesophase content of a pitch can be measured, for example, by imbedding various samples of the pitch in epoxy, followed by polishing the samples until they become highly reflective. A series of images can be recorded in order to quantify the anisotropic content.

The term "blend" as used herein refers to a mixture of two or more pitches. Blends may be produced by, for example, solution blending, melt mixing in a heated mixer, physically blending a pitch in its liquid state and a different pitch in its solid state, or physically blending the pitches in their solid forms. Suitable solvents for solution blending can include benzene, toluene, naphthalene, xylenes, pyridine, quinoline, aromatic cuts from refining, or chemicals processes such as decant oil, reformate, tar distillation cuts, and so on. Solution blending, solid state blending, and/or melt blending may occur at a temperature of from about 20° C. to about 400° C.

As used herein, "thermoset matrix" refers to a synthetic polymer reinforcement typically transformed from a liquid state to a solid state through a non-reversible chemical change. A thermoset matrix may also include cement, concrete, ceramic, glasses, metal, or metal alloys. A thermoset matrix can be incorporated with resins such as polyesters, vinyl esters, epoxies, bismaleimides, cyanate esters, polyimides or phenolics. When cured by thermal and/or chemical (catalyst or promoter) or other means, the thermoset matrix become substantially infusible and insoluble. After cure, a thermoset matrix cannot be returned to its uncured state. Composites made with thermoset matrices are strong and have very good fatigue strength. Such composites can be extremely brittle and may have low impact-toughness. For example, thermoset matrix can be used for high-heat applications and/or chemical resistance is needed.

As used herein, "thermoplastic matrix" refers to polymers that can be molded, melted, and remolded without altering its physical properties. In some cases, a thermoplastic matrix can be tougher and less brittle than thermosets, with very good impact resistance and damage tolerance. In some other cases, a thermoplastic matrix may be held below its glass transition temperature, thus may be glassy and very brittle. Since the matrix can be melted, the composite materials can be easier to repair and can be remolded and recycled easily. Thermoplastic matrix can be less dense than thermoset matrix, making them a viable alternative for weight critical applications.

As used herein, "tensile strength" means the amount of stress applied to a sample to break the sample. It can be expressed in Pascals or pounds per square inch (psi). ASTM D3379 can be used to determine tensile strength of articles produced using a polymer.

Unless otherwise indicated, extensional rheology data of pitch compositions of the present disclosure were recorded in a commercial filament stretching rheometer, model VADER™1000 from Rheo Filament. The relationship between the extensional rheology of a pitch and the requisite parameters required to successfully spin the said pitch (e.g., the spinning window) are described further in detail.

As used herein, "Hencky strain" means a logarithmic form of strain, the result of integrating a series of incremental mechanical deformations.

The "radial Hencky strain", ER, can be calculated using the following equation:

$$\varepsilon_R = -2\ln\frac{r(t)}{r_0} \quad \text{Equation 1}$$

where r(t) is a radius of the extended fiber at time t, and $r_0$ is the initial radius of the fiber before extension. The maximal radial Hencky strain refers to the measured strain immediately prior to filament breakage.

The "axial Hencky strain", $\varepsilon_{axial}$, can be calculated using the following equation:

$$\varepsilon_{axial} = \ln\frac{L(t)}{L_0} \quad \text{Equation 2}$$

where L(t) is the length of the fiber at time t, and $L_0$ is the initial length of the fiber before extension. The maximal axial Hencky strain refers to the measured strain prior to filament breakage.

As used herein, "drawn down ratio" refers to the linear speed of the fibers after drawing (e.g., linear speed of the godet roll) divided by the linear speed of the fibers after extrusion). For example, the draw down ratio during melt drawing may be calculated as follows:

Draw Down Ratio=$A/B$ where A is the linear speed of the fiber after melt drawing (e.g., godet speed); B is the linear speed of the extruded fiber and can be calculated as follows:

Extruder linear fiber speed=$4C/(\pi*D*E2)$ where C is the throughput through a single hole (grams per minute); D is the melt density of the pitch (grams per cubic centimeter); and E is the diameter of the orifice (in centimeters) through which the fiber is extruded.

$$DR = \frac{R_{Nozzle}^2}{R_{Fiber}^2} = \frac{V_{Winding}}{V_{Nozzle}} \quad \text{(equation 7)}$$

$$\varepsilon_D = -2\ln\frac{R_{Fiber}}{R_{Nozzle}} = \ln(DR) \quad \text{(equation 5)}$$

Numerical ranges used herein include the numbers recited in the range. For example, the numerical range "from 1 wt % to 10 wt %" includes 1 wt % and 10 wt % within the recited range and all points within the range.

As used herein, a "glass transition temperature" ($T_g$) refers to a mid-point of the temperature at which a continuous step change in heat capacity (or peak at the first derivative of heat flow) is recorded on the second heating scan of a differential scanning calorimeter (DSC) experiment at 10° C./min heating and cooling rate. For purposes of the disclosure herein, $T_g$ may be measured using thermal analysis TA INSTRUMENTS Q2000™, as indicated.

The "softening point" refers to a temperature or a range of temperatures at which a substance softens. Herein, the softening point (SP) is measured using a METTLER TOLEDO dropping point instrument, such as METTLER TOLEDO DP70, according to a procedure analogous to ASTM D3104.

The "microcarbon residue test", also referred to as "MCRT", is a standard test method for the determination of carbon residue (micro method). The carbon residue value of the various petroleum materials serves as an approximation of the tendency of the material to form carbonaceous type deposits under degradation conditions similar to those used in the test method, and can be useful as a guide in manufacture of certain stocks. However, care needs to be exercised in interpreting the results. This test method covers the determination of the amount of carbon residue formed after evaporation and pyrolysis of petroleum materials under certain conditions and is intended to provide some indication of the relative coke forming tendency of such materials. Herein, the MCRT is measured according to the ASTM D4530-15 standard test method.

Mass spectrometry is used herein to determine the molecular composition of a pitch. Fourier Transform-Ion Cyclotron Resonance Mass Spectrometry (FT-ICR MS) generates the high mass accuracy and high mass resolution needed for analyzing a pitch. In order to create ions in the gas phase for mass analysis from non-volatile pitch samples, laser desorption/ionization (LDI) is utilized. Solid pitch samples can be weighed out and dissolved in tetrahydrofuran (THF) by sonicating for 5 minutes to 10 minutes, to produce a solution of a final concentration of approximately 2,000 ppm. Small aliquots (<5 μL) of the pitch solution can be then deposited onto MALDI targets, and after the solvent evaporated, the targets can be loaded into the MALDI instrument. The MALDI instrument is equipped with a dual source, ion source capable of operating with both electrospray and matrix-assisted laser desorption/ionization (ESI and MALDI, respectively) modes. Ions are created by irradiating the target surface with a solid state, Nd:YAG laser (λ=355 nm). The pitch sample can be irradiated and ions generated and transmitted via ion optics to the center of a superconducting magnet (15 Tesla) and contained in an ion trap where they undergo a circular motion due to a Lorentz Force from the magnetic field. Once contained, ions may be excited to a larger radius and an image current can be measured. The frequency of the said current is directly correlated to the mass-to-charge (m z) of the ions. In order to generate ions with minimal fragmentation, the laser may be operated with a laser power of 11%, just above ionization threshold. The pitch sample can be irradiated and 200 individual scans may be acquired and averaged to generate one final average mass spectrum representative of the pitch samples. The data may be acquired from m/z 200-3,000 in absorption mode. The source optics can be tuned as such: skimmer 1 22.0V, funnel RF amplitude 120 Vpp, funnel 1 140 V, transfer line RF 350.0 Vpp, octopole frequency 1.0 MHz, octopole RF amplitude 350 Vpp, Q1 mass of 300. In order to detect and complete the mass analysis, the ion cell may be operated at: front and back trap plates 2.0V, gated injection DC bias 1.5V, side kick 0.0V, back trap plate quench −30.0V, continuous ramped power excitation. Once completed, peak lists can be exported and formula assignments can be made.

FT-ICR MS can provide heteroatom class distribution and Z-distribution that can be used to construct model-of-composition for heavy hydrocarbons, in conjunction with the molecular weight distribution. FT-ICR MS can provide composition of petroleum in terms of hydrogen deficiency (Z number), heteroatom content (SNO) and total carbon number distribution. The detailed fractionation can help to narrow Z distributions of the pitch compositions and significantly enhance the dynamic range of FT-ICR MS. The ultra-high resolution enabled the resolution of overlapping peaks. Hence, FT-ICR MS can provide three layers of chemical information for a petroleum system. The first level is heteroatomic classes (or compound classes), such as hydrocarbons (HC), hydrocarbons containing 1 sulfur atom in the molecule (1S), hydrocarbons containing 1 nitrogen atom in the molecule (1N), 2 oxygen atoms in the molecule (2O), 1 nitrogen and 1 oxygen atom in the molecule (1N1O), etc. The second level is Z-number distribution (or homologous series distribution) within each compound class. Z is defined as hydrogen deficiency as in general chemical formula, $CH_{2c+Z}N_nS_sO_o$, wherein where c is the number of carbons, Z is the number required to produce the number of hydrogen atoms (e.g., benzene, $C_6H_6$ would be $C_6H_{2\times6+(z=-6)}$, so benzene's Z number would be −6), s is the number of sulfur atoms and o is the number of oxygen atoms. The more negative the Z-number, the more unsaturated the molecule. Another commonly used term is called double bond equivalent (DBE). For a typical petroleum system, DBE=C−h/2+n/2+1 where n is the number of nitrogen atoms. Thus, Z can be closely related to double bond equivalents and can be expressed as Z=−2×(DBE)+n+2. The third level of information is the total carbon number distribution or molecular weight distribution of each homologue. If the compound core structure is known, total alkyl side-chain information can be derived.

As used herein, $M_n$ is number average molecular weight, $M_w$ is weight average molecular weight, and $M_z$ is z average molecular weight. Molecular weight distribution (MWD), also referred to as polydispersity index (PDI), is defined to be $M_w$ divided by $M_n$. Unless otherwise noted, all molecular weight units (e.g., $M_w$, $M_n$, $M_z$) are g/mol.

The present disclosure illustrates spinnable pitch compositions capable of achieving a radial Hencky strain of about 0.7 or greater at spinning temperature ($T_s$) ranging from about SP-30° C. to about SP+80° C. The carbon fiber breakage can be caused, for example, by: the loss of ability for a mesophase pitch to flow through the spinneret; the structural weak points in the carbon fiber that are created by size variations; the build-up of tensile stress in the molten material sufficient to cause filament breakage; the formation of volatiles that causes gas to form, leading to fiber breakage and coking in the spinneret. Therefore, it would be desirable to identify conditions suitable for spinning fiber from a given pitch prior to spinning. The present disclosure includes methods for evaluating whether a given pitch composition would be suitable for spinning fiber and what the requisite conditions would be thereto. Advantageously, the present disclosure provides new tools for (a) evaluating the spinnability of a given pitch composition, (b) tailoring the critical process conditions necessary to reliably spin carbon fiber, and (c) reliably producing pitches with suitable rheological properties for spinning into carbon fiber. The present disclosure further provides an evaluation of the spinnability of a pitch composition which relies on measuring the extensional rheology of a pitch and determining quantitative measures of the pitch composition's properties (e.g., maximal radial Hencky strain, maximal stress at break, maximal engineering strain), while requiring very little material to measure these properties.

Various uses for the carbon fiber composites formed from the pitch compositions of the present disclosure are also discussed herein. Such a carbon fiber composite may be useful in numerous applications where weight reductions paired with strength and stiffness enhancements are desired. Said carbon fiber composite may also be useful in offshore drilling (e.g., offshore drilling for oil and gas production) to improve corrosion resistance, fatigue and heat resistance, production components including, but not limited to platforms, risers, tethers, anchors, drill stems or related equipment and systems. Additional product applications can include automotive (e.g., body parts such as deck lids, hoods, front end, bumpers, doors, chassis, suspension systems such as leaf springs, drive shafts), aerospace (aircraft and space systems), sports equipment (e.g., golf club, tennis racket, bikes, ski boards, snowboards, helmets, rowing or water skiing equipment), construction (non-structural and structural systems), military (e.g., flying drones, armor, armored vehicles, military aircraft), wind energy industries, energy storage applications, fireproof materials, carbon-carbon composites, carbon fibers, in many insulating and sealing materials used in construction and road building (e.g., concrete), turbine blades, light weight cylinders and pressure vessels, off-shore tethers and drilling risers, medical equipment, for example.

Pitch Compositions and Methods for Production Thereof

Pitch compositions described herein can be capable of achieving a radial Hencky strain prior to break of about 0.7 or greater at spinning temperature ($T_s$) ranging from about SP−30° C. to about SP+80° C., such as a radial Hencky strain of from 0.7 to 10. Generally, the pitch spinning temperature may be ranging from about 30° C. below the softening point of the pitch to about 80° C. above the softening point of the pitch. The pitch may be capable of achieving an axial strain of less than about 8, and/or an extensional viscosity of about 5 Pa·s or greater, such as an extensional viscosity of about 5 Pa·s to about 500,000 Pa·s. Pitch compositions are described further below.

The pitch compositions of the present disclosure may be isotropic pitches or mesophase pitches.

The isotropic pitch of the present disclosure may be obtained from any suitable feed selected from the group consisting of: main-column-bottom (MCB), hydrotreated main column bottom, steam cracker tar, hydrotreated steam cracker tar (HDT-SCT), crude oils, hydrotreated crude oils, coal tar pitch, petroleum pitch, vacuum residue (VR), atmospheric residue, asphalt, asphaltenes, bitumen, reformate, coker gas oil, heavy coker gas oil, thermal tar, thermal distillation cuts, and any combination thereof.

The process of production of the mesophase pitch is not restricted to any specific process. Therefore, coal tar, naphtha tar, pyrolysis tar, decant oil, or pitch-like substances produced by distillation or thermal treatment of such heavy oils, or the like may be used as the starting material for the production of mesophase pitches. The percentage of mesophase within a pitch can be increased by heat-treating the pitch one or more times at a temperature well above its softening point for a period. Without being bound by any theory, the mesophase content can affect the spinning, such as when the percentage of mesophase increases, the viscosity increases and so does the temperature dependence on the viscosity. A mesophase pitch of the present disclosure may show a non-Newtonian behavior, which can be revealed by a change in viscosity with shear rate. Also, the extensional rheology of the pitches can be more sensitive. An isotropic feed can have a lower viscosity than an anisotropic feed, and can be spun at a lower temperature. Carbon fibers produced from isotropic pitches may be more bendable than the carbon fibers produced from mesophase pitches, whereas the carbon fibers produced from mesophase pitches can be brittle.

The pitch compositions may have a mesophase content of about 5 vol % or less (or about 4.5 vol % or less, or about 4 vol % or less, or about 3.5 vol % or less, or about 3 vol % or less, or about 2.5 vol % or less, or about 2 vol % or less, or about 1.5 vol % or less, or about 1 vol % or less, or about 0.5 vol % or less), based on the total volume of the pitch composition.

Alternately, the pitch compositions may have a mesophase content greater than about 5 vol % (or about 10 vol % or greater, or about 15 vol % or greater, or about 20 vol % or greater, or about 25 vol % or greater, or about 30 vol % or greater, or about 35 vol % or greater, or about 40 vol % or greater, or about 45 vol % or greater, or about 50 vol % or greater, or about 55 vol % or greater, or about 60 vol % or greater, or about 65 vol % or greater, or about 70 vol % or greater, or about 75 vol % or greater, or about 80 vol %, or about 85 vol % or greater, or about 90 vol % or greater, or about 95 vol % or greater, or about 98 vol % or greater), based on the total volume of the pitch composition.

The pitch compositions may have a carbon residue content of from about 20 wt % to about 99 wt %, such as from about 30 wt % to about 99 wt %, such as from about 40 wt % to about 99 wt %, such as from about 50 wt % to about 99 wt %, such as from about 50 wt % to about 95 wt %, such as from about 50 wt % to about 90 wt %, such as from about 50 wt % to about 85 wt %, and such as from about 50 wt % to about 80 wt %, based on the total weight of the pitch composition.

The pitch compositions can be characterized using mass spectrometry. Methods for characterizing a pitch (e.g., petroleum pitch) using mass spectrometry, comprises one or more of: transferring the pitch to a MALDI target; generating pseudomolecular ions and molecular ions from the pitch using laser desorption/ionization; analyzing at least one mass-to-charge ratio of the pitch on a high resolution Fourier Transform Ion Cyclotron Resonance Mass Spectrometer (FT-ICR MS) in a positive mode; assigning at least one molecular formula to the detected pseudomolecular ions and molecular ions; and generating molecular weight distributions and molecular compositions of the pitch. Herein, the peak resolution can be from about 100,000 to about 3,000,000 (or from about 200,000 to about 3,000,000, or from about 200,000 to about 2,500,000, or from about 300,000 to about 2,500,000, or from about 300,000 to about 2,000,000, or from about 400,000 to about 2,000,000, or from about 500,000 to about 2,000,000, or from about 600,000 to about 1,900,000, or from about 700,000 to about 1,800,000, or from about 800,000 to about 1,700,000, or from about 900,000 to about 1,600,000, or from about 1,000,000 to about 1,500,000) at m/z of from about 50 to about 1,000 (or from about 100 to about 900, or from about 200 to about 800, or from about 300 to about 700). For example, the peak resolution can be from about 1,300,000 at m/z 400. Pseudomolecular ions and molecular ions can be generated with an ultraviolet, solid state laser by ablating the sample, and acquiring the mass spectra. Molecular formula of the pitch can be determined from accurate mass measurements, enabling the amount of double bond equivalents to be measured.

The pitch composition may comprise one or more of the following: at least 80 wt % hydrocarbon species, 0 wt % to 20 wt % 1-sulfur (1S), 0 wt % to 5 wt % 2-sulfur (2S), 0 wt % to 15 wt % 1-oxygen (1O), 0 wt % to 5 wt % 2-oxygen (2O), 0 wt % to 5 wt % 1S1N, 0 wt % to 5 wt % 1N1O, 0 wt % to 5 wt % 1S1O, 0 wt % to 5 wt % 1S2O, 0 wt % to 1 wt % 2S1O, 0 wt % to 1 wt % 2N2O.

The pitch composition may have an m/z range value of about 250 to about 1,000 comprising at least 60% of pitch ion current (such as at least 65%, such as at least 70%, such as at least 75%, such as at least 80%), as determined by FT-ICR MS.

The pitch composition may be an isotropic pitch having a Z number distribution (Z) in the range of about −250 to about −10 (or about −240 to about −10, or about −230 to about −10, or about −220 to about −10, or about −210 to about −10, or about −200 to about −10, or about −200 to about −12, or about −190 to about −12, or about −180 to about −12, or about −160 to about −14, or about −150 to about −14, or about −140 to about −12, or about −130 to about −14, or about −120 to about −16, or about −110 to about −20).

The pitch composition may be an isotropic pitch having an $M_n$ in the range of m/z from about 400 to about 800 (or about 420 to about 780, or about 440 to about 760, or about 460 to about 740, or about 480 to about 720, or about 500 to about 700). For example, the isotropic pitch may have an $M_n$ of m/z 652.

The pitch composition may be an isotropic pitch having an $M_W$ in the range of m/z from about 400 to about 1,100 (or 405 to 1,000, or 410 to 975, or 415 to 950, or 415 to 925, or 420 to 900, or 420 to 880, or 440 to 860, or 460 to 840, or 480 to 820, or 500 to 800). For example, the isotropic pitch may have an $M_w$ of m/z 697.

The pitch composition may be an isotropic pitch comprising about 35% or greater of Z=6 to −50, about 60% or greater of Z=−51 to −100, and about 2% or greater of Z greater than −100 molecular species by total ion intensity.

Alternately, the pitch composition may be a mesophase pitch having a Z number distribution (Z) in the range of about −300 to about −20 (or −250 to −10, or −252 to −12, or −254 to −14, or −256 to −16, or −258 to −18, or −260 to −20, or −270 to −20).

The pitch composition may be a mesophase pitch having an $M_n$ in the range of m/z from about 500 to about 1,200 (or 500 to 1,100, or 525 to 1,000, or 550 to 950, or 600 to 900, or 650 to 850).

The pitch composition may be a mesophase pitch having an $M_W$ in the range of m/z from about 500 to about 1,000 (or 550 to 950, or 600 to 900, or 650 to 850).

The pitch composition may be a mesophase pitch comprising less than 5% of Z=6 to −50, about 40% or greater of Z=−51 to −100, about 30% or greater of Z=−101 to −150, about 10% or greater of Z=−151 to −200, and about 0.1% or greater of Z greater than −200 molecular species by total ion intensity.

Alternately, the pitch composition may be a mesophase pitch having a Z number distribution (Z) in the range of about −250 to about −10 (or −252 to −12, or −254 to −14, or −256 to −16, or −258 to −18, or −260 to −20).

The pitch composition may be a mesophase pitch having an $M_n$ in the range of m/z from about 500 to about 1,000 (or 550 to 950, or 600 to 900, or 650 to 850).

The pitch composition may be a mesophase pitch having an $M_w$ in the range of m/z from about 500 to about 1,000 (or 550 to 950, or 600 to 900, or 650 to 850).

The pitch composition may be a mesophase pitch comprising less than 5% of Z=6 to −50, about 40% or greater of Z=−51 to −100, about 30% or greater of Z=−101 to −150, about 10% or greater of Z=−151 to −200, and about 0.1% or greater of Z greater than −200 molecular species by total ion intensity.

The pitch compositions suitable for spinning generally have a softening point of less than about 400° C. (or about 350° C. or less, or about 300° C. or less, or about 250° C. or less, or about 200° C. or less, or about 150° C. or less, or about 100° C. or less), as determined according to a procedure analogous to the ASTM D 3104 test method, wherein the procedure can be carried out under nitrogen, at a 2° C./min ramp rate up to a temperature of about 400° C.

The pitch composition of the present disclosure may have a glass transition temperature ($T_g$) of less than about 315° C. (or about 275° C. or less, about 235° C. or less, or about 195° C. or less, or about 155° C. or less, or about 115° C. or less, or about 75° C. or less), as determined using the second heating scan of a differential scanning calorimetry (DSC) experiment at 10° C./min heating and cooling rate performed under inert atmosphere ($N_2$).

The pitch composition of the present disclosure may be capable of achieving a radial Hencky strain prior to break of from about 0.7 to about 10 (wherein the lower limit may be about 0.7, 0.8, 0.9, 1.0, 1.1, 1.2, 1.3, 1.4, etc.), at a spinning temperature ($T_s$) ranging from about 30° C. below softening point of the pitch composition to about 80° C. above softening point of the pitch composition. The pitch compositions may capable to achieve a radial Hencky strain prior to break from about 0.7 to about 10, such as from about 1 to about 10, such as from about 1.5 to about 10, such as from about 2 to about 10, such as from about 2.5 to about 10, such as from about 3 to about 10, such as from about 3.5 to about 10, such as from about 4 to about 10, or such as from about 4.5 to about 10.

The pitch compositions may have an axial strain ranging from about 0.1 to about 8 (wherein the upper limit may be less than or equal to about 7.5, 7, 6.5, 6, 5.5, 5, 4.5, 4, 3.5, 3, etc., and may go as low as about 1, 0.9, 0.8, 0.7, 0.6, 0.5, 0.4, 0.3, 0.2, 0.1, etc.), at a spinning temperature ($T_s$) ranging from about 30° C. below softening point of the pitch composition to about 80° C. above softening point of the pitch composition.

The pitch compositions may have an extensional strain rate ranging from about 0.1 $s^{-1}$ to about 100 $s^{-1}$ (wherein the lower limit may be greater than or equal to about 0.1 $s^{-1}$, 0.2 $s^{-1}$, 0.3 $s^{-1}$, 0.4 $s^{-1}$, 0.5 $s^{-1}$, 0.6 $s^{-1}$, 0.7 $s^{-1}$, 0.8 $s^{-1}$, 0.9 $s^{-1}$, 1.0 $s^{-1}$, etc.) at a spinning temperature ($T_s$) ranging from about 30° C. below softening point of the pitch composition to about 80° C. above softening point of the pitch composition. The pitch compositions may have an extensional strain rate from about 0.1 $s^{-1}$ to about 100 $s^{-1}$, such as from about 0.1 $s^{-1}$ to about 95 $s^{-1}$, such as from about 0.5 $s^{-1}$ to about 90 $s^{-1}$, such as from about 0.5 s- to about 80 $s^{-1}$, such as from about 0.5 $s^{-1}$ to about 70 $s^{-1}$, such as from about 0.5 $s^{-1}$ to about 60 $s^{-1}$, such as from about 1 $s^{-1}$ to about 50 $s^{-1}$, such as from about 1 $s^{-1}$ to about 40 $s^{-1}$, such as from about 1 $s^{-1}$ to about 30 $s^{-1}$, such as from about 1 $s^{-1}$ to about 20 $s^{-1}$, such as from about 1 $s^{-1}$ to about 20 $s^{-1}$, such as from about 1 $s^{-1}$ to about 15 $s^{-1}$, such as from about 1 $s^{-1}$ to about 10 $s^{-1}$, such as from about 1.5 $s^{-1}$ to about 10 $s^{-1}$, such as from about 2 $s^{-1}$ to about 10 $s^{-1}$, such as from about 2.5 to about 10 $s^{-1}$, such as from about 3 $s^{-1}$ to about 10 $s^{-1}$.

The pitch compositions may have a maximum critical stress of about 100 Pa or greater (or about 250 Pa or greater, or about 500 Pa or greater, or about 750 Pa or greater, or about 1,000 Pa or greater). For example, the pitch compositions may have a maximum critical stress from about 100 Pa to about 10,000,000 Pa, such as from about 250 Pa to about 7,500,000 Pa, such as from about 500 Pa to about 1,500,000 Pa, such as from about 1,000 Pa to about 1,000,000 Pa, such as from about 1,500 Pa to about 750,000 Pa, such as from about 2,000 Pa to about 500,000 Pa, such as from about 2,500 Pa to about 250,000 Pa. Alternately, the pitch compositions may have a maximum critical stress from about 1,000 Pa to about 50,000,000 Pa, such as from about 1,500 Pa to about 25,000,000 Pa, such as from about 5,000 Pa to about 20,000,000 Pa, such as from about 10,000 Pa to about 15,000,000 Pa.

The pitch compositions may have an extensional viscosity of about 5 Pa·s to about 500,000 Pa·s (wherein the lower limit may be about 5 Pa·s or greater, such as about 70 Pa·s or greater, such as about 75 Pa·s or greater, such as about 100 Pa·s or greater, such as about 125 Pa·s or greater, such as about 150 Pa·s or greater, such as about 200 Pa·s or greater, such as about 250 Pa·s or greater, such as about 300 Pa·s or greater, such as about 350 Pa·s or greater, such as about 400 Pa·s or greater, such as about 450 Pa·s or greater, such as about 500 Pa·s or greater, etc.) at a spinning temperature ($T_s$) ranging from about 30° C. below softening point of the pitch composition to about 80° C. above softening point of the pitch composition.

In at least one embodiment, pitch compositions suitable for spinning described herein comprise: a mesophase content of about 5 vol % or less, based on the total volume of the pitch, and a softening point (SP) of less than about 400° C.; and wherein, at a spinning temperature ($T_s$) ranging from SP−30° C. to SP+80° C., the pitch is capable of achieving a radial Hencky strain prior to break greater than about 0.7, and wherein the pitch has one or more of the following: an axial strain of less than about 8; an extensional viscosity of about 5 Pa·s or greater; a maximum critical stress of about 10,000,000 Pa or greater; and an extensional strain rate greater than 0.1 $s^{-1}$.

In an alternate embodiment, pitch compositions suitable for spinning described herein comprise: a mesophase content greater than about 5 vol %, based on the total volume of the pitch and a softening point of less than about 400° C.; and wherein, at a spinning temperature ($T_s$) ranging from about SP−30° C. to about SP+80° C., the pitch is capable of achieving a radial Hencky strain prior to break of about 0.7 to about 10, and wherein the pitch has one or more of: an axial strain of about 0.1 to about 8; an extensional viscosity of about 5 Pa·s to about 500,000 Pa·s; a maximum critical stress of about 100 Pa to about 10,000,000 Pa; and an extensional strain rate of about 0.1 $s^{-1}$ to about 100 $s^{-1}$.

The hydrocarbon feed may be a pitch feedstock formed from a variety of heavy oil and/or heavy hydrocarbonaceous fractions that include a substantial portion of aromatics. The aromatic carbons content may vary, depending on the feed. For example, the aromatic carbons content can be from about 20% to about 40% when the feed is composed of vacuum residues, or from about 50% to 70% when the feed is composed of isotropic pitch, or from about 45% to about 55% when the feed comprises main column bottoms (MCB). Some heavy oil fractions can be suitable without further processing (e.g., fractions that can be solvent extracted to produce a mesophase pitch), while other fractions can be at least partially converted to mesophase pitch feeds by heat treatment and/or performing a limited polymerization. Suitable fractions for use as pitch and/or for forming mesophase pitch can include, but are not limited to, heavy oils, coal tar fractions formed during conversion of coal to coke; bottoms fractions from fluid catalytic cracking; steam cracker tar; pitch formed from acid-catalyzed oligomerization reactions; pitch formed from air-blowing reactions; pitch formed during slurry hydroconversion and/or fixed bed hydroconversion (such as hydroconversion of heavy oils); and/or "rock" fractions generated during solvent deasphalting of a heavy oil. More generally, pitch fractions for formation of carbon fiber can be formed from any of the above sources.

The reaction zone may be a catalytic conversion zone, a thermal conversion zone, or a combination thereof. In at least one embodiment, the reaction zone is a hydrotreating zone. The reaction zone may have a temperature of about 200° C. or greater, such as from about 200° C. to about 500° C., such as from about 250° C. to about 450° C., such as from about 300° C. to about 400° C. The reaction zone may have a pressure of about 10 psig or greater (or about 12 psig or greater, or about 14 psig or greater, or about 16 psig or greater, or about 18 psig or greater, or about 20 psig or greater, or about 25 psig or greater, or about 50 psig or greater). The reaction zone may have a pressure in the range of about 200 psig to about 3,000 psig, such as about 300 psig to about 2,500 psig, such as about 400 psig to about 2,000 psig, such as about 500 psig to about 1,500 psig, and/or a weight hourly space velocity (WHSV) in the range of about 0.1 $hr^{-1}$ to about 4 $hr^{-1}$ (or about 0.2 $hr^{-1}$ to about 3.8 $hr^{-1}$, or about 0.4 $hr^{-1}$ to about 3.6 $hr^{-1}$, or about 0.6 $hr^{-1}$ to about 3.4 $hr^{-1}$, or about 0.8 $hr^{-1}$ to about 3.2 $hr^{-1}$, or about 1 $hr^{-1}$ to about 3 $hr^{-1}$). The reaction zone may contain hydrogen, nitrogen, air, steam, or other inert gases, or a combination of any number of these.

The reaction zone may contain a catalyst comprising one or more transition metal catalysts. The one or more transition metal catalysts may be selected from a group consisting of: Pt, Pd, W, V, Co, Ni, or Mo. The catalyst systems suitable for use in the disclosure herein may include a catalyst comprising one or more transition metal catalysts and one or more solid supports. The solid supports may allow a catalytic reaction, such as hydrotreatement of a pitch feedstock, to be conducted under heterogeneous conditions. In more specific embodiments, the solid support may be silica. Other suitable solid supports may include, but are not limited to, alumina, silica-alumina, porous carbons, zeolites, zirconia, titania, and refractory oxide.

The methods of the present disclosure may further comprise: separating the pitch composition in one or more separation processes. Suitable examples of separation processes may include, but are not limited to, distillation, deasphaltenation, chromatographic separation, membrane-filtration, or a combination thereof. The pitch composition may be characterized as being relatively free of impurities and ash.

Suitable diluents/solvents for separation may include non-coordinating, inert liquids. Examples include straight and branched-chain hydrocarbons, and aromatic solvents such as isobutane, ethane, propane, butanes, pentanes, isopentane, hexanes, isohexane, heptanes, octanes, dodecanes, benzene, toluene, pyridine, quinoline and mixtures thereof; cyclic and alicyclic hydrocarbons, such as cyclohexane, cycloheptane, methylcyclohexane, methylcycloheptane, and mixtures thereof; perhalogenated hydrocarbons, such as perfluorinated $C_{4-10}$ alkanes, chlorobenzene, and aromatic and alkyl-substituted aromatic compounds, such as benzenes (e.g., dimethylbenzenes), toluene, mesitylene, and xylene; and polar solvents (e.g., acetone, N,N-dimethylformamide, acetonitrile, pyridine, quinoline, dimethyl sulfoxide, N-methylpyrolidone, and mixtures thereof). In some embodiments, the solvent is substantially aromatic, wherein aromatics may be present in the solvent at a content of about 50 wt % or greater, such as about 75 wt % or greater, such as about 90 wt % or greater, based upon the total weight of the solvents.

Spinning Pitch into Fibers

After separation, the pitch composition can be spun directly into a fiber.

As discussed above, in some cases, a first pitch may be spun in combination with a second pitch, wherein the viscosity of the first pitch at a spinning temperature ($T_s$) is different from the viscosity of the second pitch at a spinning temperature ($T_s$). In some instances, the viscosity of the first pitch is greater than the viscosity of the second pitch. In other instances, the viscosity of the first pitch is lower than the viscosity of the second pitch. It may be desirable and advantageous to blend two or more pitches to control melt spinning or to control the properties of the corresponding carbon fiber formed therefrom (e.g, tensile strength). More specifically, a first pitch may be spun in combination with a second pitch, wherein the first pitch may form a first layer (e.g., an inner/central layer) and the second pitch may form a second layer (e.g., an outer layer), thus on the surface of the first layer. Other non-limiting examples, may include: 1) having the second pitch formed on the surface of the first pitch, wherein the second pitch has a greater rate of reaction with air than the first pitch to produce an oxidized layer, thus preventing the fiber from sticking during winding; 2) having a pitch that is stiffer on the outside than on the inside; 3) having a pitch that is more tolerant to surface defects on the outside than the inside; 4) having the second pitch primarily used to produce a much narrower fiber in the central/internal layer in order to increase the strength of the central/internal fiber layer; 5) having the second pitch that forms a better interface with a matrix. Filaments such as described herein may be produced, for example, using two different pitches in a bicomponent spinning machine to produce fibers that have different materials (pitches) geometrically positioned along the filament (fiber) long axis. For example, one can create "side-by-side" fibers wherein two pitches lie along the long axis of the fiber. In other examples, one can make other geometric placements such as "sheath and core" fibers. Other placements including but not limited to "tipped trilobal," "islands in the sea," or other geometries are possible.

Methods of the present disclosure may comprise: producing a carbon fiber from a pitch composition (isotropic and/or anisotropic pitch composition having a mesophase content of less than about 5 vol %, alternately a mesophase content of about 5 vol % or greater, based on the total volume of the pitch composition) described above, at a temperature within a spinning temperature ($T_s$) range, wherein the spinning temperature ($T_s$) range is determined by measuring the maximal radial Hencky strain ($\varepsilon_{R,C}$) prior to breaking at a series of different temperatures (° C.) and strain rates ($s^{-1}$); and determining the temperatures that continuously encompass the highest measured maximal radial Hencky strain ($\varepsilon_{R,max}$) from the corresponding within the range of about 0.5($\varepsilon_{R,max}$) to about 2 ($\varepsilon_{R,max}$). Alternatively, carbon fiber product requirements and process spinning designs may require a minimum process radial Hencky strain to be achieved. In such cases, the spinning window, that is, the range of conditions where filaments may be produced, can be identified by selecting the temperature range in which the corresponding maximal radial Hencky strain (εR) is at least as great as the minimum process radial Hencky strain.

Accordingly, methods of the present disclosure may comprise: producing a carbon fiber from a pitch composition at a temperature within a spinning temperature ($T_s$) range, wherein the spinning temperature ($T_s$) range is determined by measuring a maximum radial Hencky strain ($\varepsilon_{R,C}$) prior to break at a series of different temperatures (° C.) and strain rates ($s^{-1}$); and determining a temperature range wherein the corresponding maximum radial Hencky strain ($\varepsilon_{R,C}$) lies above a minimum process radial Hencky strain ($\varepsilon_{R,process}$), and wherein the minimum process radial Hencky strain ($\varepsilon_{R,process}$) is ranging from about 0.7 to about 10. The minimum process radial Hencky strain ($\varepsilon_{R,process}$) will be determined based on the product requirement from the product that will be manufactured from the fiber and the spinning process design. For instance, if a fiber with diameter 10 μm is desired, and the process spinneret has a capillary size of 300 μm, then a minimum process radial Hencky strain equal to 6.8 may be indicated.

Methods of the present disclosure may further comprise: using a spinneret with a capillary size $r_0$ and a final fiber radius of $r_f$, where the ratio of $r_f/r_0=\exp(-\varepsilon_R/2)$, wherein $r_f$ is in the range of about 1 μm to about 1,000 μm, $r_0$ is in the range of about 100 μm to about 10,000 μm, and wherein the maximal radial Hencky strain at the spinning temperature ($T_s$) range is at least $\varepsilon_R=-2 \ln r_f/r_0$. In at least one embodiment, the capillary size $r_0$ is $r_f/[\exp(-\varepsilon R/2)]$, wherein εR is 0.7 or greater, at spinning temperature ($T_s$) of 30° C. below softening point of the pitch composition to 80° C. above softening point of the pitch composition. The capillary size $r_0$ may be in the range of about 50 μm to about 5,000 μm, or about 75 μm to about 4,000 μm or about 100 μm to about 3,000 μm, or about 150 μm to about 1,500 μm, or about 200 μm to about 1,000 μm. For example, the capillary size $r_0$ may be about 300 μm.

The spinning pitch-based carbon fiber may be a melt spinning process. The process may use a pitch composition with a softening point of about 50° C. to about 400° C. (or greater than about 110° C., or greater than about 120° C., or greater than about 130° C., or greater than about 140° C., or greater than about 150° C., or greater than about 160° C., or greater than about 170° C., or greater than about 180° C., or greater than about 190° C., or greater than about 200° C., or greater than about 250° C., or greater than about 300° C., or greater than about 320° C.). The pitch composition of the present disclosure may be introduced to an extruder wherein the said pitch composition can be heated, sheared and extruded through capillaries to form the carbon fiber.

Due to the manufacturing process, the rheological properties of a pitch may significantly affect its spinnability. The shear rheology of a pitch—important in extruder operation—is typically used to characterize a pitch. However, once the pitch exits the spinneret, the extensional flow properties become the predominate parameter that governs spinnability. Measurements of the stress evolution of a pitch composition versus the radial Hencky strain can indicate the maximal stress that a fiber can withstand prior to breaking. During these measurements, the change in radius and axial position can be recorded, and the determination of the radial Hencky strain (Equation 1) and axial strain (Equation 2) can be achieved, providing the maximal strain at break. Measurements of the radial Hencky strain, the axial Hencky strain, and the stress at various temperature and strain rate (as described above) may only require minimal amounts of the pitch composition. The extensional rheological properties can be measured on a wide range of pitch compositions in order to identify the ones suitable for spinning, and to quantify the effects of processing conditions on spinability. These measured properties can be further used as indicators of fiber structure and/or fiber properties.

The spinnability can be also affected by the presence of volatile components, which can form gas bubbles during spinning, causing a break in the fiber during spinning. It is important that the pitch have as few volatiles species as possible present at the spinning temperature ($T_s$). The amount of volatiles present can be estimated by thermal gravimetric analysis (TGA) of the pitch at the spinning temperature ($T_s$). Pitch of the present disclosure may have a content of volatiles in the range of 0 wt % to about 1 wt %, preferably in the range of 0 wt % to about 0.5 wt %.

Further, optimization of the spinning conditions based on the rheological properties of a pitch can affect the draw down ratio (DDR). The higher the DDR, the higher the orientation of the mesophase, and the higher tensile modulus along the fiber axis. The DDR was determined from the velocity ratio at spinning conditions.

An isotropic pitch-based fiber may have a DDR ranging from about 100 to about 5000 (or from about 200 to about 4,000, or from about 300 to about 3,000, or from about 400 to about 2,000, or from about 500 to about 1,000), at a processing temperature near to spinning temperature ($T_s$).

A mesophase pitch-based fiber may have a DDR ranging from about 1.5 to about 2,000 (or from about 10 to about 1,500, or from about 50 to about 1,250, or from about 100 to about 1,000), at a processing temperature near to spinning temperature ($T_s$).

Once the fiber is spun, it can be subjected to oxidation, carbonization, and/or graphitization, the said fiber (often referred to as a green fiber) thusly converted into a stabilized fiber, carbon fiber and/or graphite fiber.

Various methods have been proposed in the prior art for stabilization of pitch-based carbon fibers, and the method most generally practiced is that in which an oxidation treatment is carried out in an oxygen-containing atmosphere, such as air. The stabilization of pitch fiber is a solid phase oxidation reaction by which pitch is converted to a less meltable, or a non-meltable form. In some cases, the air may comprise $NO_2$ as an oxidative gas. Stabilization improves the handling of the carbon fiber and enables the fiber to be carbonized without melting. The oxidation of the surface layer of the fiber is generally faster than that of the central portion of the fiber, and thus a stabilized fiber having different degrees of oxidation at the surface layer and at the central portion may be formed. In some cases, it may be found that the oxidation at the surface layer and at the central portion can be controlled to optimum degrees by adding water to the oxidative atmosphere such as air.

The stabilized pitch may then be subjected to carbonization by prolonged heating at temperatures in the range of from 500° C. to 2,000° C. in an inert or largely inert atmosphere. If graphitization is desired, the carbonized fibers may then be graphitized by additional prolonged heating at temperatures from about 1,600° C. to 3,000° C. in an inert or largely inert atmosphere.

Carbon Fiber Composites, and Methods for Production Thereof.

Furthermore, methods of the present disclosure provide a carbon fiber composite comprising: a carbon fiber produced from a pitch composition capable of achieving a radial Hencky strain prior to break of about 0.7 or greater, at spinning temperature ($T_s$) ranging from about 30° C. below softening point of the pitch composition to about 80° C. above softening point of the pitch composition.

The present disclosure further provides a method for forming a composite material where a carbon fiber formed from a single pitch or a blend of two or more pitches, and a matrix. The matrix may be a thermoset matrix, a thermoplastic matrix, or a combination thereof.

The carbon fiber composite may comprise a carbon fiber produced from a pitch capable of achieving a radial Hencky strain prior to break greater than 0.7 or greater, at spinning temperature ($T_s$) ranging from about 30° C. below softening point of the pitch composition to about 80° C. above softening point of the pitch composition. The carbon fiber composite may contain from about 1 vol % to about 70 vol % of a carbon fiber and from about 99 vol % to about 30 vol % of a matrix, based on the total volume of the carbon fiber composite.

The matrix used herein can be produced from a thermoset polymer (e.g., cyclopentadiene, dicyclopentadiene, epoxy, pitch, phenolic resins, vinylester, polyimide and polyesters), a thermoplastic polymer (e.g., a thermoplastic polymer including one or more of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide), cement, concrete, ceramic, metal, metal alloy, or a combination thereof. For example, a pitch itself can be used as a matrix and/or binder for a carbon fiber composite by impregnating a number of oxidized fiber, carbon fiber, or graphite fibers, or oxidized, carbonized, or graphitized fibrous webs with pitch and carbonizing the assemblage, thus enabling production of carbon-carbon composites. In such cases, the carbon fibers can be laid into a desired form and then impregnated. Then, the resulting materials can be carbonized at high temperatures to form a solid block of carbon. Oftentimes, the impregnation with a pitch is repeated several times before the final carbon product can be formed. Such method can be commonly employed when producing carbon brakes.

The present disclosure also relates to methods for making carbon fiber composites comprising: combining at least one composite filler comprising a carbon fiber produced from the forgoing spinnable pitch composition with at least one matrix, wherein the matrix can be a thermoset matrix, a thermoplastic matrix, cement, concrete, ceramic, metal, metal alloy, or a combination thereof. The composite filler may be used in the carbon fiber composite after the stabilization, carbonization, or graphitization processes. The composite filler can be either short, or continuous, mat, bundle, unidirectional or multidirectional, and woven or nonwoven. For example, composite fillers can be nonwovens and/or continuous filament yarns. Continuous filaments can be wound onto spools and also nonwoven fabrics such as meltblown or spunbond fabrics where fibers are laid into fibrous webs or mats. The carbon fiber composite parts can be produced using conventional molding, roving, autoclave or pultrusion processes.

In at least one embodiment, the described carbon fiber composites exhibit superior stiffness, strength, corrosion resistance, density, thermal and/or electrical conductivities, than similar composites that do not incorporate carbon fibers. In addition, composites reinforced with carbon fiber versus other strengthening agents tend to be lighter in weight and exhibit higher specific strengths (strength normalized relative to mass). Additionally, such carbon fiber composites can exhibit a low coefficient of thermal expansion, particularly where a high graphitic content fiber is used. Such properties can be tailored by controlling the orientation/texture in pitch of the carbon fibers.

End Uses

Carbon articles can comprise carbon fiber composites described herein that comprise: a pitch composition suitable for spinning comprising a pitch having a softening point (SP) below 400° C. and capable of achieving a radial Hencky strain prior to break of about 0.7 to about 10, at spinning temperature ($T_s$) ranging from about SP−30° C. to about SP+80° C., and wherein the pitch may have a mesophase content of about 5 vol % or less, based on the total volume of the pitch; an axial Hencky strain ranging from about 0.1 to about 8; an extensional strain rate ranging from about 0.1 $s^{-1}$ to about 100 $s^{-1}$; a maximum critical stress ranging from about 1,000 Pa to about 10,000,000 Pa; and/or an extensional viscosity ranging from about 5 Pa·s to about 500,000 Pa·s. Alternately, the pitch may have a mesophase content ranging from about 5 vol % to 100 vol %, based on the total volume of the pitch; an axial Hencky strain ranging from about 0.1 to about 8; an extensional strain rate ranging from about 0.1 $s^{-1}$ to about 100 $s^{-1}$; a maximum critical stress ranging from about 1,000 Pa to about 10,000,000 Pa; and/or an extensional viscosity ranging from about 5 Pa·s to about 500,000 Pa·s.

Non-limiting examples of carbon articles may include automotive body parts (e.g., deck lids, hoods, front end, bumpers, doors, chassis, suspension systems such as leaf springs, drive shafts), off-shore tethers and drilling risers, wind turbine blades, insulating and sealing materials used in construction and road building (e.g., concrete), aircraft and space systems, high-performance aquatic vessels, airplanes, sports equipment, flying drones, armor, armored vehicles, military aircraft, energy storage systems, fireproof materials, lightweight cylinders and pressure vessels, and medical devices. Furthermore, fibers of the present disclosure (e.g., fiber filaments or webs) may be used as insulation materials (e.g., thermal or acoustic), or as shielding materials (e.g., electromagnetic or radio frequency), or in friction control surfaces (e.g., brake pads, such as aircraft brake pads). Carbon fibers may be included with graphitic foams, and pitch compositions with the preceding properties may be used to produce graphitic foams, for protection against explosions and the like.

To form the pitch compositions, and further the carbon fiber composites, in accordance with at least one embodiment of the present disclosure, the pitch compositions may be mixed according to any suitable mixing methods to produce the forgoing spinnable pitch composition, and spun into carbon fibers (e.g., green carbon fibers). The as-spun carbon fiber (e.g., green carbon fiber) may be subsequently oxidized to form a stabilized carbon fiber and may further undergo a carbonization and graphitization process under inert conditions to yield a carbon fiber filler. Stabilization, carbonization and graphitization conditions may be used according to methods apparent to those skilled in the art. The carbon fiber filler may comprise the stabilized, carbonized, or graphitized carbon fiber. The carbon fiber filler may then be used to form the carbon articles and/or otherwise incorporated in related pitch compositions.

Embodiments disclosed herein include:

A. Pitch compositions suitable for spinning. The pitch compositions suitable for spinning comprise: a pitch having a softening point (SP) below 400° C. and capable of achieving a radial Hencky strain prior to break of about 0.7 to about 10, at spinning temperature ($T_s$) ranging from about SP−30° C. to about SP+80° C.

B. Processes for producing carbon fibers. The processes comprise: producing a carbon fiber from a pitch composition at a temperature within a spinning temperature ($T_s$) range, wherein the spinning temperature ($T_s$) range is determined by measuring a maximum radial Hencky strain ($\varepsilon_R$) prior to break at a series of different temperatures (° C.) and strain rates ($s^{-1}$); and determining a temperature range wherein the maximum radial Hencky strain ($\varepsilon_R$) lies above a minimum process radial Hencky strain, and wherein the minimum process radial Hencky strain is within a range of about 0.7 to about 10.

C. Carbon fiber composites. The carbon fiber composites comprise of a carbon fiber produced from a pitch composition, wherein the pitch composition comprises: a pitch having a softening point (SP) below 400° C. and capable of achieving a radial Hencky strain prior to break of about 0.7 to about 10, at spinning temperature ($T_s$) ranging from about SP−30° C. to about SP+80° C.

Each of embodiments A, B, and C may have one or more of the following additional elements in any combination:

Element 1: wherein the pitch comprises a mesophase content of about 5 vol % or less, based on the total volume of the pitch.

Element 2: wherein the pitch comprises a mesophase content of about 0.1 vol % to about 2 vol %, based on the total volume of the pitch.

Element 3: wherein the pitch comprises a mesophase content of about 0.1 vol % to 100 vol %, based on the total volume of the pitch.

Element 4: wherein the pitch comprises mesophase from about 5 vol % to 100 vol %, based on the total volume of the pitch.

Element 5: wherein the pitch is capable of achieving an axial Hencky strain prior to break ranging of about 0.1 to about 8 at spinning temperature ($T_s$) ranging from about SP−30° C. to about SP+80° C.

Element 6: wherein the pitch axial Hencky strain, or pitch radial Hencky strain lies within the extensional strain rate ranging from about 0.1 $s^{-1}$ to about 100 $s^{-1}$.

Element 7: wherein the pitch is capable of achieving an axial Hencky strain ranging from about 0.1 to about 8 at spinning temperature ($T_s$) ranging from about SP−30° C. to about SP+80° C., and wherein the pitch has an extensional strain rate ranging from about 0.1 $s^{-1}$ to about 100 $s^{-1}$.

Element 8: wherein the pitch has a maximum critical stress ranging from about 100 Pa to about 10,000,000 Pa.

Element 9: wherein a maximum critical stress is from about 1,000 Pa to about 10,000,000 Pa.

Element 10: wherein the pitch composition comprises a mixture of two or more pitches.

Element 11: wherein the pitch has an extensional viscosity ranging from about 5 Pa·s to about 500,000 Pa·s.

Element 12: wherein the softening point (SP) is ranging from about 100° C. to about 350° C.

Element 13: wherein the pitch has a glass transition temperature ($T_g$) of about 65° C. to about 275° C.

Element 14: wherein the pitch has a carbon residue content of from about 20 wt % to about 99 wt %, based on the total weight of the pitch composition.

Element 15: wherein the pitch composition is combined with a matrix material.

Element 16: wherein the pitch composition is used as a matrix in the production of a composite.

Element 17: wherein the matrix material is a thermoset matrix, a thermoplastic matrix, cement, concrete, ceramic, metal, metal alloy, or a combination thereof.

Element 18: wherein the thermoplastic matrix is selected from a group consisting of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide, and any combination thereof.

Element 19: wherein a fiber, an oxidized fiber, carbonized fiber, graphitized fiber, fiber web, oxidized fiber web, carbonized fiber web, or graphitized fiber web are prepared using the pitch composition.

Element 20: wherein the carbon fiber is produced by spinning two or more pitches together.

Element 21: wherein the two or more pitches each have different viscosities.

Element 22: wherein the two or more pitches each have different softening points (SP).

Element 23: wherein the pitch comprises a mesophase content of about 5 vol % or less, based on the total volume of the pitch.

Element 24: wherein the pitch comprises a mesophase content ranging from about 0.1 vol % to about 100 vol %, based on the total volume of the pitch.

Element 25: wherein the pitch is capable of achieving an axial Hencky strain ranging from about 0.1 to about 8, and an extensional viscosity ranging from about 5 Pa·s to about 500,000 Pa·s.

Element 26: wherein the pitch is spun using an extensional strain rate ranging from about 0.1 $s^{-1}$ to about 100 $s^{-1}$ during spinning.

Element 27: wherein the pitch has a glass transition temperature ($T_g$) of about 65° C. to about 275° C.

Element 28: wherein the pitch has a carbon residue content ranging from about 20 wt % to about 99 wt %, based on the total weight of the pitch composition.

Element 29: wherein the pitch is spun with two or more pitches.

Element 30: a carbon article comprising the carbon fiber.

Element 31: wherein the method comprises using a spinneret with a capillary size ($r_0$) and a final fiber radius ($r_f$), where $r_f$ is in the range of about 1 μm to about 1,000 μm, $r_0$ is in the range of about 100 μm to about 10,000 μm, and wherein the maximal radial Hencky strain at the spinning temperature ($T_s$) range is at least $$\varepsilon_R = -2\ln\frac{r(t)}{r_0}.$$

Element 32: wherein $r_0$ is in the range of about 100 μm to about 5,000 μm.

Element 33: wherein the pitch composition comprises: a pitch having a softening point (SP) below 400° C., at spinning temperature ($T_s$) ranging from about SP−30° C. to about SP+80° C.

Element 34: wherein the pitch has a mesophase content of about 5 vol % or less, based on the total volume of the pitch.

Element 35: wherein the pitch has a mesophase content of about 5 vol % to 100 vol %, based on the total volume of the pitch.

Element 36: wherein the pitch has an extensional viscosity is ranging from about 5 Pa·s to about 500,000 Pa·s.

Element 37: wherein the pitch has an axial Hencky strain ranging from about 0.1 to about 8.

Element 38: wherein the pitch is subjected to an extensional strain rate ranging from about 0.1 $s^{-1}$ to about 100 $s^{-1}$ under spinning conditions.

Element 39: wherein the pitch has a carbon residue content ranging from about 20 wt % to about 99 wt %, based on the total weight of the pitch composition.

Element 40: wherein the method further comprises: spinning the pitch with two or more pitches.

Element 41: wherein the two or more pitches each have different viscosities.

Element 42: wherein the two or more pitches each have different softening points (SP).

Element 43: wherein the method further comprises: producing a carbon article comprising the carbon fiber.

Element 44: wherein the carbon fiber is combined with a matrix material to produce the composite.

Element 45: wherein the matrix material is a thermoset matrix, a thermoplastic matrix, cement, concrete, ceramic, metal, metal alloy, or a combination thereof.

Element 46: wherein the thermoplastic polymer is selected from a group consisting of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide, and any combination thereof.

Element 47: wherein the carbon fiber composite further comprises a filler, and wherein the filler is selected from the group consisting of: carbon fiber, glass fiber, metal fiber, boron fiber, pitch, carbon black, and combinations thereof.

By way of non-limiting example, exemplary combinations applicable to A include, but are not limited to: 1 and 2; 1 or 2 and 3; 1 or 2 and 4; 1 or 2 and 5; 1 or 2 and 6; 1 or 2, and 6 and 7; 1 or 2, and 7; 1 or 2, and 8; 1 or 2, and 6-8; 1 or 2, and 7 and 8; 1 or 2, and 9; 1 or 2, and 6-9; 1 or 2, and 10; 1 or 2, and 11; 1 or 2, and 12; 1 or 2, and 13; 1 or 2, and 12 and 13; 1 or 2, and 13 and 14; 1 or 2, and 15; 1 or 2, and 15-18; 1 or 2, and 17; 15 and 16; 15 and 17; and 15 and 18; and 1 or 2, and 19.

By way of non-limiting example, exemplary combinations applicable to B include, but are not limited to: 20 and 21; 20 or 21 and 22; 20 or 21, and 23; 20 or 21, and 24; 20 or 21, and 25; 20 or 21, and 26 and 27; 20 or 21, and 28; 20 or 21, and 29; 20 or 21, and 30; 20 or 21, and 30-33; 20 or 21, and 34 and 35; 20 or 21, and 36-38; 20 or 21, and 41; and 20 or 21, and 42.

By way of non-limiting example, exemplary combinations applicable to C include, but are not limited to: Element 44-47: 44 and 45; 44 or 45 and 46; 44 or 45, and 47; and 44 or 45, and 46 and 47.

To facilitate a better understanding of the embodiments of the present disclosure, the following examples of preferred or representative embodiments are given. In no way should the following examples be read to limit, or to define, the scope of the present disclosure.

EXAMPLES

Isotropic pitch (Sample 1) was prepared as follows: An 80:20 blend of main columns bottoms:steam cracked tar was hydrotreated. The resulting liquid product was vacuum distilled, and the non-distilling portion was deasphalted in pentane and cooled to −78.5° C. with dry ice. The insoluble material was filtered, collected and washed. The isolated insoluble fraction is an isotropic pitch (Sample 1) with the following properties: a softening point of 158.3° C., an MCRT of 53.1 wt %, and a $T_g$ of 98° C.

Anisotropic pitches, Sample 2 at 0.5 vol % mesophase (based on the total volume of the anisotropic pitch), and Sample 3 at 14 vol % mesophase (based on the total volume of the anisotropic pitch), were prepared as follows: the isotropic pitch (Sample 1) was converted into the corresponding anisotropic pitches (e.g., Samples 2 and 3) by heat treating at 400° C. for 3 hours and 4 hours, respectively. Sample 1 was heat treated at 400° C. for 3 hours at ambient pressure with a continuous flow of nitrogen, and yielded 73% of Sample 2 (0.5 vol % mesophase, based on the total volume of the anisotropic pitch) with the following properties: an MCRT of 76.7 wt % and a $T_g$ of 104° C. Sample 1 was heat treated at 400° C. for 4 hours, and yielded 68% of Sample 3 (14 vol % mesophase, based on the total volume of the anisotropic pitch) with the following properties: an MCRT of 80 wt % and a $T_g$ of 114° C. The mesophase content was measured by embedding the pitch samples in epoxy, solidifying the sample, followed by polishing the samples until the surface of said pitch samples were highly reflective. Then, a series of images were acquired to quantify the anisotropic content. Accordingly, 11 images were acquired for Sample 2, and 15 images were acquired for Sample 3.

Rheology measurements were performed using the commercial filament stretching rheometer, model VADER™1000 from Rheo Filament. Accordingly, extensional rheological properties were measured on various pitches in order to identify the pitches suitable for spinning, as well as the conditions for properly spinning these materials. Evaluation of the rheological properties and spinning window of pitches are further described.

Figure 1B:
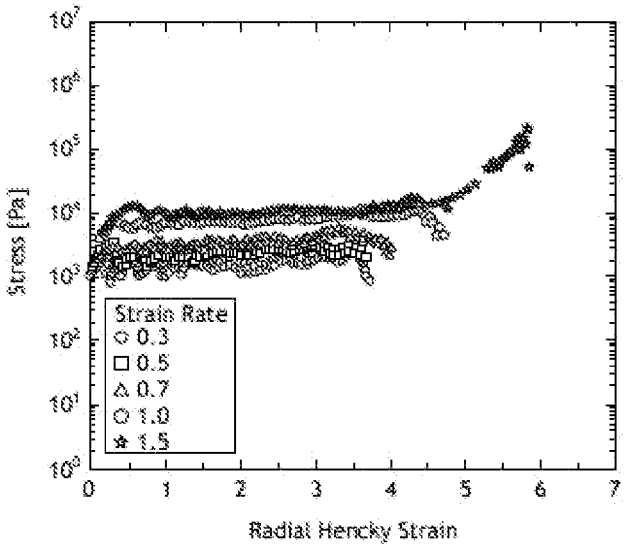
FIG. 1B is a graph depicting the stress (Pa) versus the radial Hencky strain of an isotropic pitch, at different strain rates ($s^{-1}$), at 150° C.

FIGS. 1A and 1B illustrate the extensional rheological measurements performed on an isotropic pitch (Sample 1), at different strain rates (e.g., strain rate: 0.3 $s^{-1}$, 0.5 $s^{-1}$, 0.7 $s^{-1}$, 1 $s^{-1}$, and 1.5 $s^{-1}$), at 150° C. The LVE in FIG. 1A shows the viscosity that would be expected if there were no strain hardening.

The resulting data shows that the extensional viscosity $\eta^+$ increased with time. For example, at a strain rate of 1.5 $s^{-1}$, the extensional viscosity $\eta^+$ increased from about $1\times10^4$ Pa·s to about $4\times10^5$ Pa·s within 5.2 seconds, while at a strain rate of 0.3 $s^{-1}$, the extensional viscosity $\eta^+$ increased from about $1\times10^4$ Pa·s to about $9.5\times10^4$ Pa·s within 11.1 seconds. Thus, determination of the capability of a pitch to build up stress, a requirement for fiber forming, is provided by this rheological measurement.

FIG. 1A is a graph depicting the extensional viscosity $\eta^+$(Pa·s) versus the radial Hencky strain of an isotropic pitch (Sample 1), at different strain rates (e.g., strain rate: 0.3 $s^{-1}$, 0.5 $s^{-1}$, 0.7 $s^{-1}$, 1 $s^{-1}$, and 1.5 $s^{-1}$), at 150° C.

FIG. 1B is a graph depicting the stress (Pa) versus the radial Hencky strain of an isotropic pitch (Sample 1), at different strain rates (e.g., strain rate: 0.3 $s^{-1}$, 0.5 $s^{-1}$, 0.7 $s^{-1}$, 1 $s^{-1}$, and 1.5 $s^{-1}$), at 150° C. The results indicated that the stress was dependent on the strain rate and suggested conditions at which filaments can be formed without breaking.

Figure 2:
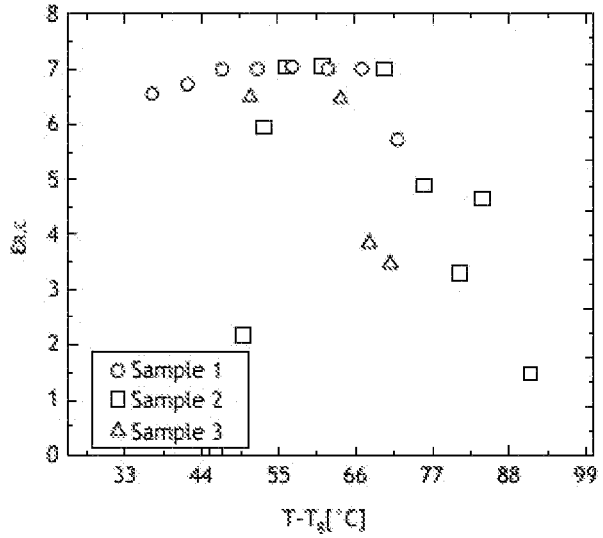
FIG. 2 is a graph depicting the maximal radial Hencky strain at break $\varepsilon_{R,C}$ versus the difference in temperature from its corresponding glass transition temperature (° C.) of various pitches.
Figure 3:
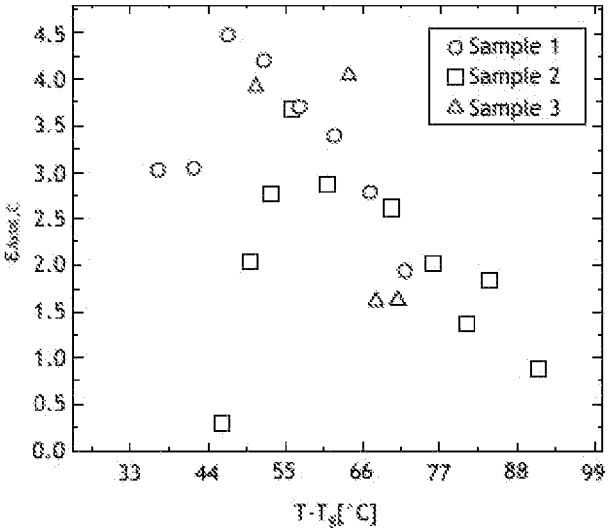
FIG. 3 is a graph depicting the maximal axial Hencky strain at break $\varepsilon_{Axial,C}$ versus the difference in temperature from its corresponding glass transition temperature (° C.) of various pitches.
Figure 4:
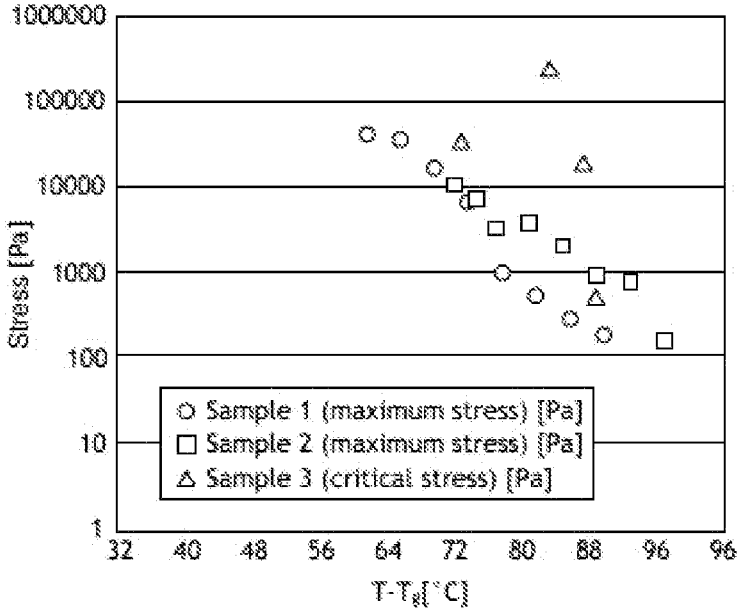
FIG. 4 is a graph depicting the maximal stress and the critical stress at break (Pa) versus the difference in temperature from its corresponding glass transition temperature (° C.) of various pitches.

Additional measurements were taken at a number of different temperatures to determine the temperature dependence of maximal radial Hencky strain at break, maximal axial Hencky strain at break, and maximal stress at break, as illustrated in FIGS. 2-4. In FIGS. 2-4, Sample 1 was used as a feed to prepare various pitches with different mesophase contents (e.g., Samples 2 and 3). Sample 2 (0.5 vol % mesophase, based on the total volume of the pitch) and Sample 3 (14 vol % mesophase, based on the total volume of the pitch) were prepared by heat treating at 400° C., at a series of different times. The temperature difference ($T-T_g$) along the x-axis referred to the difference between the temperature measurement and the glass transition temperature $T_g$ of the pitch as measured by DSC. When a pitch has a low mesophase content (e.g., a mesophase content of about 70 vol % or less, based on the total volume of the pitch), the optimal spinning temperature ($T_s$) window for a pitch can be evaluated by using T-$T_g$ as a parameter, or by the softening point (SP). However, when a pitch comprises higher mesophase content, such as a mesophase content of about 70% vol % or greater, based on the total volume of the pitch, it is preferable to use the temperature difference between the actual temperature T and the softening point of the pitch (not shown) because $T_g$ may not be readily measured by DSC. Softening point is a simple metric that measures the temperature at which a material will flow through a specified hole. $T_g$ measured by DSC, can yield ambiguous results for samples when the DSC glass transition temperatures, and/or solid-liquid crystal phase transitions of the mesophase domains, are ill-defined. As the mesophase content increased, measurement of $T_g$ using DSC became more difficult as the change in heat capacity became less distinct due to broadening. $T_g$ and softening point are generally correlated.

FIG. 2 depicts the maximal radial Hencky strain at break for Samples 1-3 at different temperatures. It was observed that for Sample 2, the radial Hencky strain $\varepsilon_{R,C}$ plateaued at about 7, at a temperature range T-$T_g$ of about 55° C. to about 70° C., which indicated the optimal spinning temperature ($T_s$) window for Sample 2 at a 0.5 vol % mesophase, based on the total volume of the pitch. In order to prevent minor temperature deviations from disrupting the fiber spinning process, the spinning temperature ($T_s$) should be carried out near $\varepsilon_{R,C}$ plateau so that temperature variations would give the same material property. If the spinning is carried out at about 77° C. above T-$T_g$, then there is a severe temperature dependence on strain, leading to potential fiber breakage or variation in the diameter of the fiber as strain could vary significantly with even small variations in temperature.

FIG. 3 is a graph depicting the maximal axial Hencky strain at break for Samples 1-3 at different temperatures. For example, evaluation of Sample 2 showed that a peak in the maximal axial strain occurred at a temperature range T-$T_g$ of about 50° C. to about 65° C., indicating that the optimal temperature window for this particular pitch at a 0.5 vol % mesophase, was still in accordance with the optimal spinning temperature ($T_s$) window obtained during the maximal radial Hencky strain at break measurements. Hence, the results indicated if and when a pitch should spin. For example, Sample 1 could spin at T-$T_g$ of about 33° C. to about 50° C., whereas such conditions should not be applied for spinning Sample 2. A reduction in the processing window with increase in heat treatment time was observed.

FIG. 4 depicts the critical stress at break (Pa) at different temperatures T-$T_g$ for Sample 3, and the maximum stress at break (Pa) at different temperatures T-$T_g$ for Samples 1 and 2, wherein Sample 2 is a mesophase pitch having a mesophase content of 0.5 vol %, based on the total volume of the pitch. FIG. 4 indicates the maximum stress and the critical stress that a fiber can withstand prior to breaking. The critical stress at break of Sample 3 (14 vol % mesophase, based on the total weight of the pitch) revealed an optimal spinning temperature ($T_s$) window T-$T_g$ of about 50° C. to about 70° C., which is also in accordance with the measurements obtained above. The results indicated that in order to be suitable for fiber production the material needs to be able to develop and withstand extensional stress, otherwise no fiber would be produced. The maximum of the critical stress was a material limit that was measured and only seen in Sample 3. The maximum stress obtained in Samples 1 and 2 was the maximum reliably measured stress, but not a material limit. Distinguishing between the maximum stress and the critical stress at break measured was necessary because the instrument's force sensitivity dropped to within the noise and could not reliably be measured. Hence, stress values obtained after this threshold were not reported. The maximum stress values were not material limits, but instrumental limits. If these measurements were repeated using a larger diameter of pitch sample, material limits could potentially be obtained.

Measurements illustrated in FIGS. 2, 3, and 4 showed that the maximal strain which a fiber can withstand prior to break, and the maximal stress at break, were both highly temperature-dependent and unique for each sample. The results obtained from the above described measurements reveal the optimal temperature window that these pitches can be successfully spun. Therefore, for a particular pitch having a defined vol % mesophase, and at a desired final radius, the maximal values for strain and stress can be measured and used to provide insight into suitable spinning conditions to produce the desired fiber. Using these findings with related mathematical relationships described herein can provide an indication of the maximal capillary radius in the die for carbon fiber production.

Figure 5:
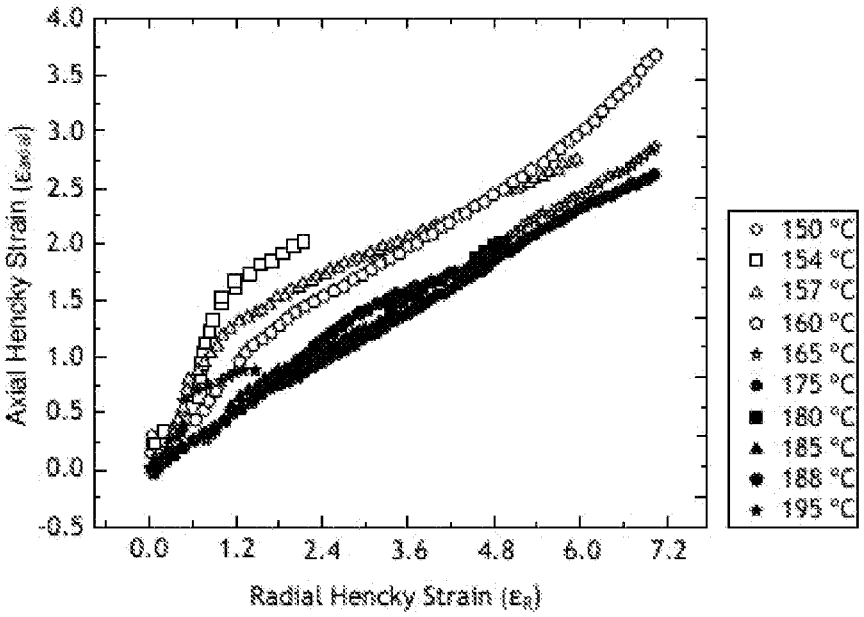
FIG. 5 is a graph depicting the axial Hencky strain $\varepsilon_{Axial,C}$ versus the radial Hencky strain ER of a pitch containing 0.5 vol % mesophase, based on the total volume of the pitch, at various temperatures (° C.).
Figure 6:
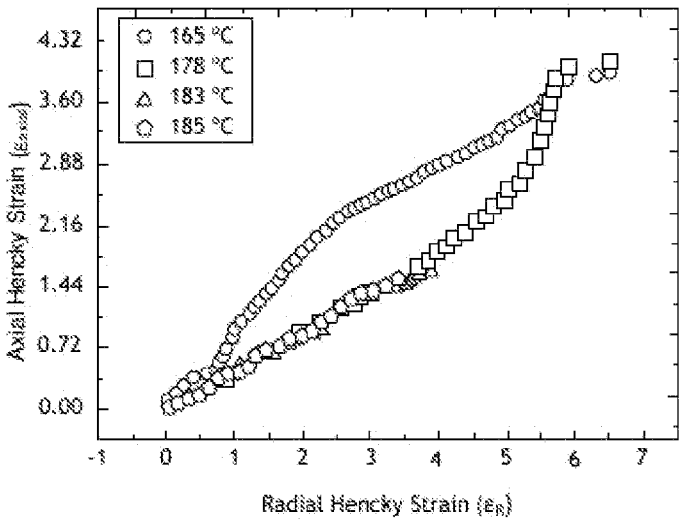
FIG. 6 is a graph depicting the axial Hencky strain $\varepsilon_{Axial,C}$ versus the radial Hencky strain ER of a pitch containing 14 vol % mesophase, based on the total volume of the pitch, at various temperatures (° C.).

FIGS. 5 and 6 illustrate the temperature dependence of both the axial Hencky strain and radial Hencky strain for Sample 2 (0.5 vol % mesophase), and Sample 3 (14 vol % mesophase), respectively. Additionally, these measurements revealed the axial Hencky strain dependence on radial Hencky strain and revealed how much the material must stretch to achieve a given radial strain. The measurements obtained herein provided a clear, quantitative, descriptions of the appropriate spinning temperature ($T_s$) range, the maximal radial, and axial Hencky strains that a fiber can sustain, as well as the maximal stress a fiber can withstand, the maximum achievable draw down ratio (DDR), and the maximum capillary size suitable in dies for a given pitch in order to achieve a desired carbon fiber diameter.

FIG. 5 illustrates the axial Hencky strain dependence on radial Hencky strain ($\varepsilon_R$) at a strain rate of 1 $s^{-1}$ for Sample 2 undergoing extensional flow at various temperatures. Each temperature represented an experiment carried out from a strain value of 0 to a maximum strain value. FIG. 5 shows there was a strong temperature dependence on both maximum axial and radial Hencky strain, and also illustrates the axial Hencky strain dependence on radial Hencky strain. The range of maximum axial Hencky strains were 0.5 to about 3.5, and the maximal radial Hencky strain range was about 0 to about 7. The effect of temperature of the axial Hencky strain dependence on radial Hencky strain is illustrated for temperatures of 160° C. and 175° C. At these temperatures the maximum axial Hencky strain varied from 3.6 to 2.6, while the maximum radial Hencky strain remained fixed at about 7. For Sample 2, the axial Hencky strain was strongly temperature dependent, while the maximum radial Hencky strain was relatively temperature independent.

FIG. 6 illustrates the axial Hencky strain ($\varepsilon_{Axial}$) versus the radial Hencky strain ($\varepsilon_R$) at a strain rate of 1 $s^{-1}$ for Sample 3. The axial Hencky strain $\varepsilon_{Axial}$ and the radial Hencky strain ER of the pitch were continuously measured during the experiment. FIG. 6 shows that, as the temperature increased, the axial and radial Hencky strains decreased. The maximum axial Hencky strain value of about 4 and a maximum radial Hencky strain value of about 6.6, occurred at a temperature of from 165° C. to 175° C., whereas at a temperature of from 183° C. to 185° C., a maximum axial Hencky strain value of about 1.44 and a maximum radial Hencky strain value of about 3.5 to about 4 were obtained. Additionally, FIG. 6 illustrates the significant change that occurred for the axial Hencky strain dependence on radial Hencky strain as temperature increased at temperatures 183° C. and 185° C. A linear response up to fiber breakage was obtained. However, when the temperature decreased to 178° C., a linear response up to about a radial Hencky strain of 5 was obtained. Beyond this radial Hencky strain value, the axial Hencky strain rapidly increased. As the temperature decreased further to 165° C., an initial linear response up to about 1 radial Hencky strain was obtained. Beyond this value, the axial Hencky strain rapidly increased up to a radial Hencky strain of about 2.5. As the radial Hencky strain increased above 2.5, a linear response was observed. These results highlight the extreme temperature dependence of rheological properties and highlight the importance of understanding these properties to produce stable spinning conditions. The results demonstrated that the Hencky strain properties had a strong temperature dependence and showed that even a 5° C. change in temperature (going from 178° C. to 183° C.) can have a significant impact on the minimum attainable fiber diameter. For example, for a capillary diameter of 1 mm, the smallest fiber achievable at $\varepsilon_R$=6.6 is about 40 μm, whereas $\varepsilon_R$=3.5 would yield about 170 μm fiber diameter. Optimizing the spinning conditions based on the rheological properties of a given pitch affects the draw down ratio (DDR) and is very critical in obtaining the maximum performance for the production of the fiber, as well as achieving a steady state for spinning the pitch (such as continuous spinning). The higher the DDR, the higher the orientation of the mesophase, and the higher tensile modulus along the fiber axis.

Figure 7:
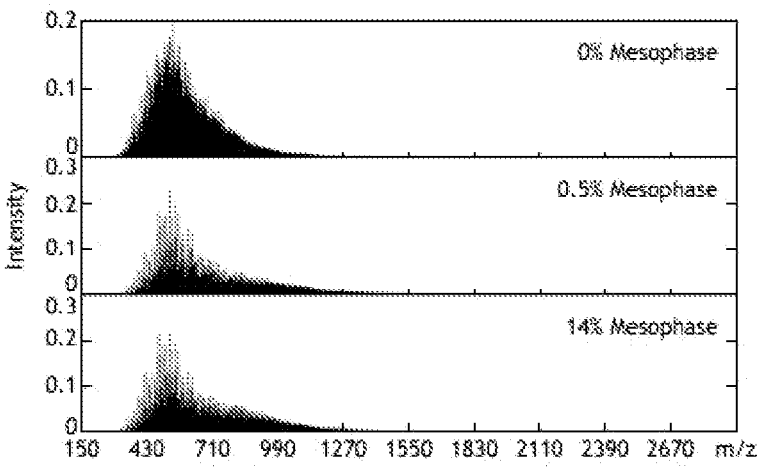
FIG. 7 is a graph depicting the average molecular weight distribution of three pitch samples having 0 vol % mesophase, 0.5 vol % mesophase, and 14 vol % mesophase, based on the total volume of the pitch.

FIG. 7 is a graph depicting the average molecular weight distribution of Sample 1 (0 vol % mesophase), Sample 2 (0.5 vol % mesophase), and Sample 3 (14 vol % mesophase), wherein the m/z of detected ions ranged from approximately m/z 250 to 1550. As the mesophase content increased the MW profiles remained relatively unchanged. The increase in mesophase content did lead to the generation of low Z-class species but high molecular weight growth was not seen in the mass spectrometry data generated using laser desorption/ionization.

Figure 8:
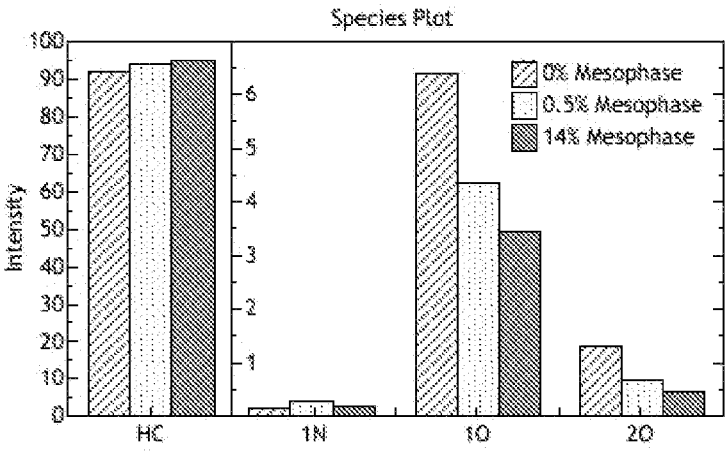
FIG. 8 is a plot of the most abundant species present in three pitch samples having 0 vol % mesophase, 0.5 vol % mesophase, and 14 vol % mesophase, based on the total volume of the pitch. HC is species containing only carbon and hydrogen, 1N is hydrocarbon species containing 1 nitrogen, 1O is hydrocarbon species containing 1 oxygen, and 2O is hydrocarbon species containing 2 oxygen atoms.

FIG. 8 is a plot of the most abundant species (hydrocarbon (HC), hydrocarbons containing 1-nitrogen atom (1N), hydrocarbons containing 1-oxygen atom (1O), and hydrocarbons containing 2-oxygen atoms (2O)) and Z number distribution of Sample 1 (0 vol % mesophase), Sample 2 (0.5 vol % mesophase), and Sample 3 (14 vol % mesophase). For clarity purpose, molecular classes of less than 0.05 wt % were not described herein. Hydrocarbon and oxygen containing species are predominant. The Z number distribution covers a wide range, indicating the presence of polyaromatic hydrocarbons and polyaromatic oxides. FIG. 8 shows that Samples 1-3 were low nitrogen pitch samples. Therefore HC, 1O species predominated the class distribution, with 2O species to lesser extent. Sample 1 comprised about 91.5 wt % hydrocarbon species, about 0.2 wt % TN, about 6.5 wt % 1O, and about 1.5 wt % 2O. Sample 2 comprised about 94 wt % hydrocarbon species, about 0.35 wt % TN, about 4.5 wt % 1O, and about 0.7 wt % 2O. Sample 3 comprised about 95 wt % hydrocarbon species, about 0.2 wt % TN, about 3.5 wt % 1O, and about 0.5 wt % 2O. These values only account for the predominant molecular classes, and the remaining molecular species compromise various combinations of 1 and 2, N/S/O compound classes (e.g., 1N1S1O) at total percentages of less than 1%.

Figure 9:
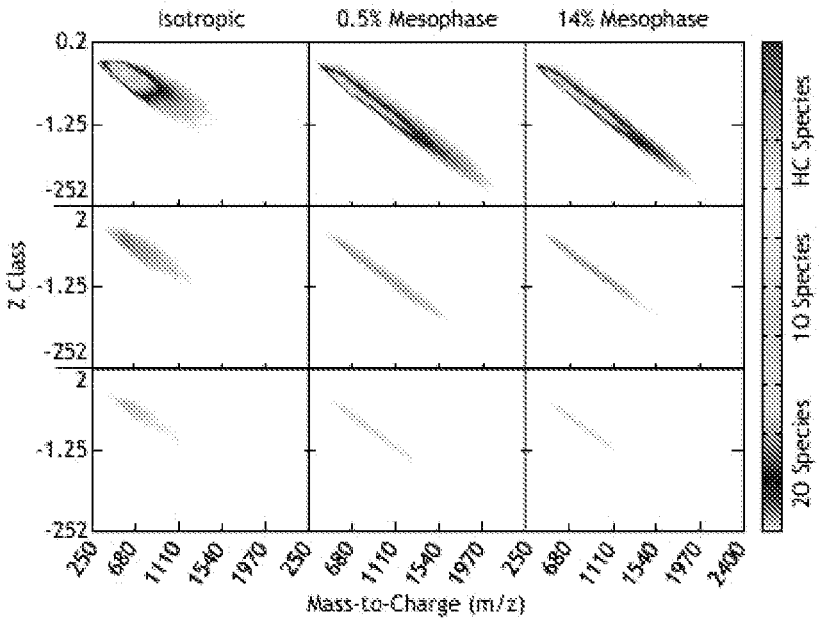
FIG. 9 is a plot of the Z number distribution versus the mass-to-charge (m z) ratios of the hydrocarbon (HC), hydrocarbons containing 1-oxygen (1O), and hydrocarbons containing 2-oxygen (2O) species present in three pitch samples having 0 vol % mesophase, 0.5 vol % mesophase, and 14 vol % mesophase, based on the total volume of the pitch.

FIG. 9 is a plot of the Z number distribution versus the mass-to-charge (m z) ratios of the hydrocarbon (HC), 1-oxygen (1O), and 2-oxygen (2O) containing species present in Sample 1 (0 vol % mesophase), Sample 2 (0.5 vol % mesophase), and Sample 3 (14 vol % mesophase). Details of the amount of molecules identified for a given Z number range are summarized in Table 1. The intensities of the molecules identified were summed for a given Z number range for Samples 1-3. While the untreated pitch composition (e.g., Sample 1) comprised a Z number distribution in the range of −130 to −24, the heat treated pitch compositions (e.g., Samples 2 and 3) comprised a Z number distribution in the range of −260 to −24. As illustrated in Table 1, Sample 1 contained 37.26% of Z=6 to −50, 60.49% of Z=−51 to −100, and 2.25% of Z=−101 to −150 molecular species by total ion intensity. Sample 2 contained 3.63% of Z=6 to −50, 44.94% of Z=−51 to −100, 36.75% of Z=−101 to −150, 13.59% of Z=−151 to −200, and 1.09% of Z greater than −200 molecular species by total ion intensity. Sample 3 contained 4.28% of Z=6 to −50, 47.91% of Z=−51 to −100, 36.30% of Z=−101 to −150, 11.25% of Z=−151 to −200, and 0.26% of Z greater than −200 molecular species by total ion intensity.

FIG. 9 shows image plots of the pitch samples (Samples 1-3) (HC, 10, and 20). X-axis is the mass-to-charge (m z). Y-axis is the Z number. Abundances of molecules are represented by the shades of grey scheme. Again, from Sample 1 (0% mesophase) to Sample 3 (14% mesophase), the number of molecules increased. Molecular weight growth in Samples 2 and 3 are driven by increases in core size and aromatic content, seen in the wide Z-class distribution present after heat treatment (e.g., treated samples having Z-class molecules past −200).

TABLE 1

| Z Number | Pitch Samples (Mesophase content based on total volume of the pitch sample) | | |
|---|---|---|---|
| (molecular species by total ion intensity) | Sample 1 (0 vol % Mesophase) | Sample 2 (0.5 vol % Mesophase) | Sample 3 (14 vol % Mesophase) |
| Z = 6 to −50 | 37.26 | 3.63 | 4.28 |
| Z = −51 to −100 | 60.49 | 44.94 | 47.91 |
| Z = −101 to −150 | 2.25 | 36.75 | 36.30 |
| Z = −151 to −200 | 0 | 13.59 | 11.25 |
| Z > −200 | 0 | 1.09 | 0.26 |

Figure 10A:
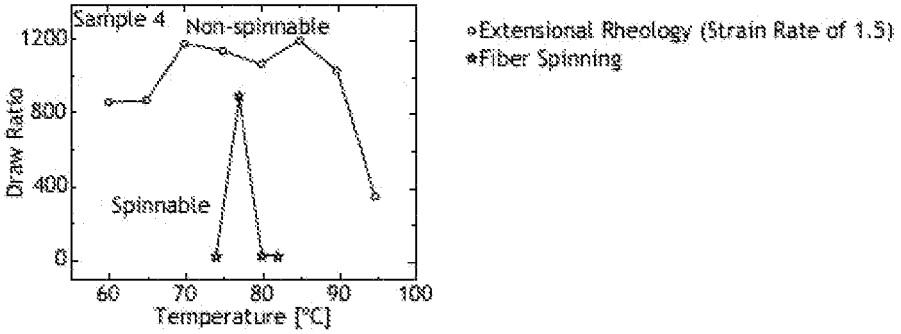
FIG. 10A is a graph depicting the critical draw down ratio (DDR) at different strain rates for an isotropic pitch and the corresponding fiber spinning data.
Figure 10B:
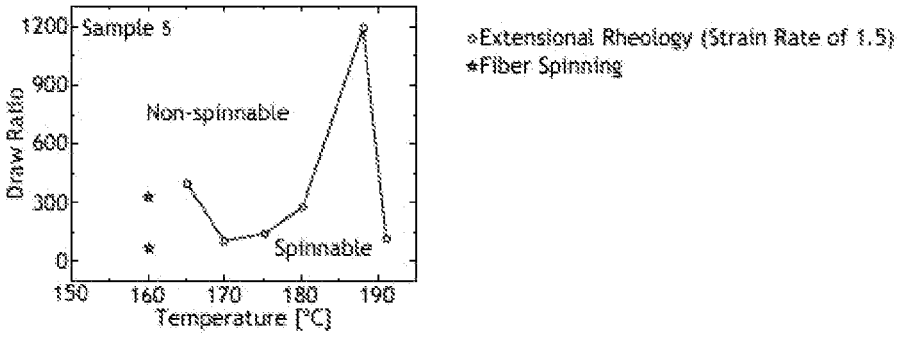
FIG. 10B is a graph depicting the critical draw down ratio (DDR) at different strain rates of a mesophase pitch (mesophase content of 3 vol %, based on the total volume of the pitch) and the corresponding fiber spinning data.
Figure 10C:
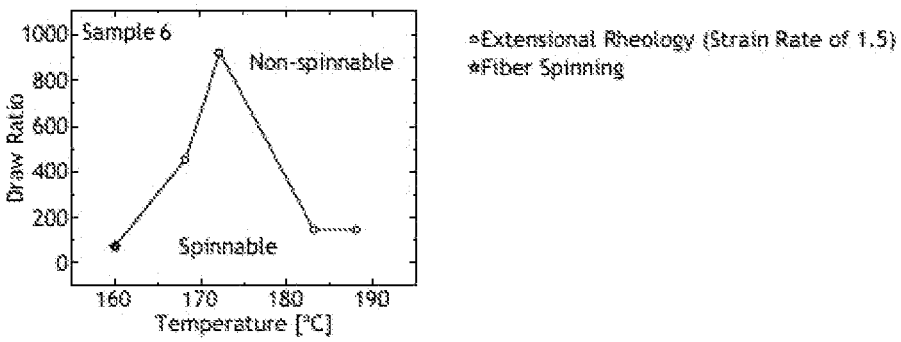
FIG. 10C is a graph depicting the critical draw down ratio (DDR) at different strain rates of a mesophase pitch (mesophase content of 17 vol %, based on the total volume of the pitch) and the corresponding fiber spinning data.

Direct correlation between extensional rheological behavior and melt-spinning process on three different pitch samples was achieved (FIGS. 10A-10C). Isotropic pitch (Sample 4), mesophase pitch having 3 vol % mesophase (Sample 5), and mesophase pitch having 17 vol % mesophase (Sample 6) were prepared from hydrotreated steam cracker tar.

Isotropic pitch (Sample 4) was prepared as follows: a steam-cracked tar was hydrotreated and the total liquid product (TLP) was separated by vacuum distillation to produce a 524° C.-559° C. distillation cut that had a softening point of 74.9° C. Said distillation cut was used to produce the anisotropic pitches (Samples 5 and 6).

The anisotropic pitches Sample 5 and Sample 6 were prepared as follows: a glass vial was loaded with about 2 g of a feed (i.e., 524° C.-559° C. distillation cut), and placed in a PAC™ Micro Carbon Residue Tester. The sample (i.e., 524° C.-559° C. distillation cut) was heated to 100° C. within 10 min under a flow of nitrogen (600 mL/min). Immediately afterwards, the sample was heated to 400° C. using a 30° C./min ramp rate and 600 mL/min nitrogen flow rate. Upon reaching 400° C., the flow rate was decreased to 150 mL/min, and the sample was held at 400° C. for the specified time (6 hours to produce Sample 5; 5 hours to produce Sample 6). After this heat soak, the sample was cooled to ambient temperature under nitrogen at a 600 mL/min flow rate over the course of several hours. Sample 5 was prepared by heat treating for 6 hours, yielding 25 wt % of the product (75 wt % volatiles), and the Sample 6 mesophase sample was prepared by heat treating for 5 hours at 400° C., and yielded 28 wt % of the mesophase pitch (72 wt % volatiles). For these particular samples, the five hour runs produced 17% mesophase, and the six hour run produced 3% mesophase. These values were checked twice using two different batches of material and found to be the same. The difference in the anticipated mesophase values could be due to variability in each run since there isn't any mixing present. While an absolute softening point was measured for each of these pitches according to ASTM D3104, it is noted that heterogeneities of softening within these samples were observed using hot stage microscopy. Thus, not all of the pitch had softened at the measured softening point of the pitch and pieces were present that would behave as a solid material at certain temperatures. This complication affected the spinning experiments by clogging the spinneret, introduced heterogeneity within the sample, and complicated the results.

General melt spinning procedure: a pitch was spun into fibers using a custom extruder. The pitch sample was loaded into the custom extruder, then brought to lowest trial spinning temperature. The loaded hopper was then let to sit for 5 minutes to 10 minutes after the extruder reached the desired spinning temperature, thus ensuring that the pitch sample was also at the chosen spinning temperature. The spinning apparatus did not use a filter, or screen, to remove any particulates that were present. Once at spinning temperature, the winding spool was set at a slow speed ~100-200 mm/s and double sided tape was placed on the outer edge of the spool to assist fixing the fiber to the spool. The winding speed was gradually increased to minimize the chance of breaking the fiber. The piston speed was then set (~0.1-0.7 mm/s) and turned on to extrude the pitch from the nozzle. Once the pitch started to come out of the nozzle, the pitch was grabbed with forceps and brought to the spinning spool. Once sufficient fiber was collected, the piston was turned off and the spool was stopped. The fiber was then collected and the process was repeated, starting with setting a new temperature. Temperatures were increased until all desired points were tested.

In order to predict the maximal draw down ratio (DDR) achievable, the critical draw down ratio (DDR) of Sample 4 (isotropic pitch), Sample 5 (3 vol % mesophase), and Sample 6 (17 vol % mesophase) was evaluated at various temperatures. Accordingly, the spinning conditions for Samples 4, 5, and 6 were predicted by measuring the critical DDR (or strains) as a function of strain rates and temperatures. The predicted spinning conditions were further tested to produce carbon fibers by using melt spinning technique described in the general melt spinning procedure above. FIGS. 10A-10C show the draw down ratio (DDR) carbon fibers produced from Samples 4, 5, and 6, along with the critical DDR determined from extensional rheology. The DDR for spinnable and un-spinnable pitch-based fiber was calculated from the diameter (equaton 7) of the fiber, and from the velocity ratio (equaton 5) from the spinning condition. FIGS. 10A-10C demonstrate that the extensional rheology results can be used as a tool for predicting the carbon fiber spinning conditions.

FIG. 10A is a graph depicting the critical DDR at different strain rates for Sample 4 (isotropic pitch) and its corresponding fiber spinning data. The isotropic pitch-based fibers were produce at temperatures close to spinning temperature ($T_s$), similar to the temperatures obtained from the extensional rheology data of Sample 4. The DDR for the isotropic pitch-based fiber (FIG. 10A) ranged from 100 to 900 at temperatures close to spinning temperature $T_s$, with the maximum DDR of 900 at 75° C. The critical DDR obtained from the extensional rheology ranged from 200 to 1,200. Since the critical DDR was estimated from the failure response of the uni-extensional stretching process, one can expect that the maximum achievable DDR for the isotropic pitch-based fibers cannot exceed this value at the corresponding temperature. The isotropic pitch-based fibers exhibited a DDR that was much lower than the critical DDR, which suggests that the diameter for the isotropic pitch-based fibers can decrease even more (or the DDR can be increased) if one adjusts the velocity ratio (i.e., increasing wind-up speed or DDR).

FIG. 10B is a graph depicting the critical DDR at different strain rates of Sample 5 and its corresponding fiber spinning data. FIG. 10C is a graph depicting the critical DDR at different strain rates of Sample 6 and its corresponding fiber spinning data. The spinning window predicted from extensional rheology of Samples 5 and 6 (FIGS. 10B and 10C) was much narrower than the one predicted for Sample 4 (FIG. 10A). A high DDR (DDR of about 1,000) was only achievable at temperatures close to the softening point (e.g., ranging from spinning temperature $T_s$ to $T_s$+10° C.), which was much narrower than 30° C. to 40° C. of the spinning window observed in Sample 4 (FIG. 10A). Fiber spinning of Samples 5 and 6 was tested at three different temperatures (160° C., 180° C., and 230° C.), and the calculated DDR values were compared to the critical DDR values. Since the temperature of 230° C. was considered out of the range for prediction from the extensional rheology, only temperatures of 160° C. and 180° C. were considered. At 180° C., Sample 5 could not be spun into continuous fibers. The results indicated that the viscosity for the molten pitch was too low (~224-292 Pas, depending on the shear rate), prompting the pitch to quickly thinned before it reached the spool. The DDR was determined from the velocity ratio (equation 5) at spinning conditions. At 160° C., the DDR of the spun fiber from Sample 5 was found to be closed to the predicted limit values. Hence, the current wind-up speed nearly reached the limit for producing a continuous fiber. Using a higher wind-up speed (or increased DDR) would lead the fiber to break.

Table 2 summarizes the spinning conditions for Sample 4.

TABLE 2

| Run | Temperature (° F.) | Temperature (° C.) | Spool Speed (mm/s) | Spinnability |
|---|---|---|---|---|
| 1 | 160 | 71 | 700 | Non Spinnable |
| 2 | 165 | 74 | 700 | Spinnable |
| 3 | 170 | 76.7 | 700 | Spinnable |
| 4 | 175 | 79.4 | 700 | Spinnable |
| 5 | 175 | 79.4 | 350 | Non Spinnable |
| 6 | 175 | 79.4 | 275 | Non Spinnable |
| 7 | 180 | 82 | 700 | Spinnable |

| Run | Piston Speed (mm/s) | $V_{Nozzle}$ (mm/s) | Draw Down Ratio (DDR) from Fiber Diameter |
|---|---|---|---|
| 1 | 0.1 | 180 | ND |
| 2 | 0.2 | 360 | 18.4 |

TABLE 2-continued

| | | | |
|---|---|---|---|
| 3 | 0.3 | 540 | 900 |
| 4 | 0.4 | 720 | 25 |
| 5 | 0.5 | 900 | ND |
| 6 | 0.6 | 1000 | ND |
| 7 | 0.7 | 1200 | 18.4 |

Table 3 summarizes the spinning conditions for Sample 5.

TABLE 3

| Run | Spinning Temperature (° C.) | Piston Speed (mm/s) | Winding Speed (mm/s) |
|---|---|---|---|
| 1 | 175 | 0.5 | 200 |
| 2 | 170 | 0.5 | 200 |
| 3 | 165 | 0.5 | 200 |
| 4 | 160 | 0.5 | 200 |
| 5 | 160 | 0.5 | 700 |
| 6 | 160 | 0.5 | 500 |
| 7 | 160 | 0.5 | 350 |
| 8 | 155 | 0.5 | 200 |
| 9 | 155 | 0.5 | 450 |
| 10 | 155 | 0.3 | 450 |
| 11 | 155 | 0.2 | 450 |
| 12 | 155 | 0.1 | 450 |
| 13 | 155 | 0.5 | 200 |

| Run | $V_{Nozzle}$ (mm/s) | Spinnability | Draw Down Ratio (DDR) from Fiber Diameter |
|---|---|---|---|
| 1 | 320 | Non Spinnable | ND |
| 2 | 320 | Non Spinnable | ND |
| 3 | 320 | Non Spinnable | ND |
| 4 | 320 | Filament broke at initial stage | ND |
| 5 | 320 | Spinnable | 330 |
| 6 | 320 | Spinnable | 73.7 |
| 7 | 320 | Filament broke at initial stage | ND |
| 8 | 320 | Filament broke at initial stage | ND |
| 9 | 320 | Filament broke at initial stage | ND |
| 10 | 190 | Non Spinnable | ND |
| 11 | 130 | Filament broke at initial stage | ND |
| 12 | 64 | Non Spinnable | ND |
| 13 | 320 | Non Spinnable | ND |

Table 4 summarizes the spinning conditions for Sample 6.

TABLE 4

| Run | Temperature (° C.) | Piston Speed (mm/s) | Winding Speed (mm/s) | $V_{Nozzle}$ (mm/s) | Spinnability | Draw Down Ratio (DDR) from Fiber Diameter |
|---|---|---|---|---|---|---|
| 1 | 160 | 0.1 | 150 | 64.5 | Spinnable | 71.8 |
| 2 | 180 | | | | Non Spinnable | ND |
| 3 | 230 | | | | Non Spinnable | ND |

All documents described herein are incorporated by reference herein for purposes of all jurisdictions where such practice is allowed, including any priority documents and/or testing procedures to the extent they are not inconsistent with this text. As is apparent from the foregoing general description and the specific embodiments, while forms of the disclosure have been illustrated and described, various modifications can be made without departing from the spirit and scope of the disclosure. Accordingly, it is not intended that the disclosure be limited thereby. For example, the compositions described herein may be free of any component, or composition not expressly recited or disclosed herein. Any method may lack any step not recited or disclosed herein. Likewise, the term "comprising" is considered synonymous with the term "including." Whenever a method, composition, element or group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

Whenever a numerical range with a lower limit and an upper limit is disclosed, any number and any included range falling within the range is specifically disclosed, including the lower limit and upper limit. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

One or more illustrative embodiments are presented herein. Not all features of a physical implementation are described or shown in this application for the sake of clarity. It is understood that in the development of a physical embodiment of the present disclosure, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for one of ordinary skill in the art and having benefit of this disclosure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to one having ordinary skill in the art and having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein.

What is claimed is:

1. A pitch composition suitable for spinning comprising: a pitch having a softening point (SP) below 400° C. and capable of achieving a radial Hencky strain prior to break of about 0.7 to about 10, at spinning temperature ranging from about SP−30° C. to about SP+80° C., wherein the pitch has a carbon residue content ranging from about 20 wt % to about 99 wt %, based on the total weight of the pitch composition.

2. The pitch composition of claim 1, wherein the pitch comprises a mesophase content of about 5 vol % or less, based on the total volume of the pitch.

3. The pitch composition of claim 1, wherein the pitch comprises mesophase content ranging from about 5 vol % to 100 vol %, based on the total volume of the pitch.

4. The pitch composition of claim 1, wherein the pitch is capable of achieving an axial Hencky strain, or radial Hencky strain within the extensional strain rate ranging from about 0.1 $s^{-1}$ to 100 $s^{-1}$.

5. The pitch composition of claim 1, wherein the pitch composition comprises a mixture of two or more pitches.

6. The pitch composition of claim 1, wherein the pitch has an m/z range value of about 250 to about 1,000 comprising at least 60% of pitch ion current.

7. The pitch composition of claim 1, wherein the pitch is an isotropic pitch having a Z number distribution (Z) in the range of about −250 to about −10.

8. A method comprising:

producing a carbon fiber from a pitch composition at a temperature within a spinning temperature range, wherein the spinning temperature range is determined by measuring a maximum radial Hencky strain (εR) prior to break at a series of different temperatures (° C.) and strain rates ($s^{-1}$); and determining a temperature range wherein the maximum radial Hencky strain (εR) lies above a minimum process radial Hencky strain, and wherein the minimum process radial Hencky strain is within a range of 0.7 to 10.

9. The method of claim 8, further comprising: using a spinneret with a capillary size (r0) and a final fiber radius (rf), where rf is in the range of about 1 μm to about 1,000 μm, $r_0$ is in the range of about 100 μm to about 10,000 μm, and wherein the maximal radial Hencky strain at the spinning temperature range is at least $$\varepsilon_R = -2\ln\frac{r(t)}{r_0}.$$

10. The method of claim 8, wherein the pitch composition comprises: a pitch having a softening point (SP) below 400° C., at spinning temperature ranging from about SP−30° C. to about SP+80° C.

11. The method of claim 8, wherein the pitch has a carbon residue content ranging from about 20 wt. % to about 99 wt. %, based on the total weight of the pitch composition.

* * * * *